US006459658B1

(12) United States Patent
Fujita et al.

(10) Patent No.: US 6,459,658 B1
(45) Date of Patent: Oct. 1, 2002

(54) ELECTRONIC TIMEPIECE HAVING THERMOELECTRIC ELEMENT

(75) Inventors: Susumu Fujita; Tokuya Akase; Joichi Miyazaki; Yoshimitsu Kurasawa, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/199,205

(22) Filed: Nov. 24, 1998

(30) Foreign Application Priority Data

Nov. 25, 1997 (JP) ..... 9-323569
Nov. 2, 1998 (JP) ..... 10-312137

(51) Int. Cl.[7] ..... G04B 1/00
(52) U.S. Cl. ..... 368/203; 361/204
(58) Field of Search ..... 368/203, 204, 368/80

(56) References Cited

U.S. PATENT DOCUMENTS

| | | | | |
|---|---|---|---|---|
| 4,003,197 | A | 1/1977 | Haber | 368/67 |
| 4,236,237 | A | 11/1980 | Ichikawa | 368/66 |
| 4,557,606 | A | 12/1985 | Meisner et al. | 368/204 |
| 4,602,165 | A | 7/1986 | Rosenberg | 368/204 |
| 4,744,067 | A | 5/1988 | Leuenberger | 368/80 |
| 5,705,770 | A | 1/1998 | Ogasawara et al. | 368/203 |
| 5,740,132 | A | 4/1998 | Ohshima et al. | 368/202 |

FOREIGN PATENT DOCUMENTS

| | | |
|---|---|---|
| EP | 0855633 | 7/1998 |
| WO | 97028491 | 8/1997 |

*Primary Examiner*—Bernard Roskoski
(74) *Attorney, Agent, or Firm*—Adams & Wilks

(57) ABSTRACT

An electronic timepiece has a thermoelectric element for generating an electromotive force in response to a temperature difference thereacross. A booster circuit boosts the electromotive force generated by the thermoelectric element. A storage mechanism stores electrical power utilizing the electromotive force boosted by the booster circuit. A power monitoring circuit monitors the electromotive force boosted by the booster circuit to detect whether the boosted electromotive force is lower than a threshold value. An oscillation circuit is driven by electrical power stored in the storage mechanism. A dividing circuit frequency-divides a signal output by the oscillation circuit. A display mechanism is driven by a display driving circuit to display time in accordance with an output signal from the dividing circuit. A display drive controlling circuit stops operation of the display driving circuit when the power monitoring circuit detects that the boosted electromotive force is lower than the threshold value.

51 Claims, 20 Drawing Sheets

ELECTRONIC TIMEPIECE HAVING THERMOELECTRIC ELEMENT

BACKGROUND OF THE INVENTION

1. Field of the Invention

The present invention relates to an electronic timepiece for storing energy generated by a thermoelectric element at a secondary battery and operated by generated power as well as energy of the secondary battery, particularly to effective use of generated power in accordance with power conservation and means for appealing situation of power generation or deficiency in the energy of the secondary battery to a user.

2. Description of the Prior Art

FIG. 2 shows a view of a structure of a thermoelectric element used in a conventional electronic timepiece having a thermoelectric element. A number of n-type semiconductors 203 and p-type semiconductors 204 are installed between a heat absorbing side substrate 202 and a heat radiating side substrate 201. The n-type semiconductors 203 and the p-type semiconductors 204 are alternately and electrically connected in series by electrodes 205 installed at the heat absorbing side substrate 202 and the heat radiating side substrate 201 and both ends thereof are led out as leads 206. A heat flow is flowed through the n-type semiconductors 203 and the p-type semiconductors 204 in parallel.

The heat absorbing side substrate 202 is thermally coupled with a rear lid of the electronic timepiece in touch with the user's arm the temperature of which is generally higher than air temperature. The heat radiating side substrate 201 is thermally coupled with a timepiece case radiating heat to the atmosphere. When a temperature difference is caused between the heat absorbing side substrate 202 and the heat radiating side substrate 201, an electromotive force is generated by the Seebeck effect.

Next, an explanation will be given of a construction of the conventional electronic timepiece having the thermoelectric element in reference to a block diagram of FIG. 14. Electromotive force of a thermoelectric element 101 having a structure shown by FIG. 2 is transmitted to a booster circuit 302, boosted by the booster circuit 302 and is stored in a storage mechanism 103. Electric energy stored in the storage mechanism 103 is supplied as power source of a timepiece unit 110. The timepiece unit 110 is constituted by an oscillation or oscillating circuit 105 using quartz having a frequency of 32 kHz or the like, a frequency dividing circuit 106 for dividing an oscillation signal thereof into a signal having a period of 1 Hz and so on, a display driving circuit 107 for driving a step motor for display in accordance with a divided output and a display unit 108 comprising a step motor, a wheel train and display hands.

According to the constitution of the conventional electronic timepiece having the thermoelectric element, when the thermoelectric element 101 generates electricity, power consumption of the timepiece unit 110 is supplied by energy from the thermoelectric element 101 and an extra amount thereof is stored in the storage mechanism 103. Meanwhile, when the electromotive force is not provided from the thermoelectric element 101, the storage mechanism 103 supplies power to the timepiece unit 110, energy held by the storage mechanism 103 is reduced and voltage of the storage mechanism 103 is gradually lowered. At this occasion, in a range of voltage by which the timepiece can be operated, naturally, energy necessary for the operation is taken out from the storage mechanism 103 and further, even after a motor is stopped and the operation of the timepiece is stopped, a certain degree of current flows, energy from the storage mechanism 103 continues being discharged and the voltage continues lowering. Further, when the voltage of the storage mechanism 103 is dropped to a degree of about 0.6 V by which current is not flowed to the timepiece unit 110, lowering of voltage is stopped and the voltage is substantially maintained.

According to the above-described conventional electronic timepiece having the thermoelectric element, when power generation of the thermoelectric element is stopped for a long period of time, the voltage of the storage mechanism is lowered to the degree of about 0.6 V and even when power generation of the thermoelectric element is restarted and starts to charge the storage mechanism, an extremely long time period is needed until the voltage reaches about 1.0 V by which the timepiece can be operated normally. Although a time period for voltage to reach 1.0 V is dependent on power generation capability and capacity of the charge mechanism, when the charge capacity is set to an amount for operating for six months, several days are required for voltage to reach 1.0 V.

When the timepiece is detached from the arm before voltage reaches about 1.0V which is voltage for operating the timepiece, the timepiece is immediately stopped without being able to utilize energy of the storage mechanism. That is, although in order to make the timepiece continue operating even when it is detached from the arm, power generation of the thermoelectric element needs to continue for several days, actually, the power generation is interrupted highly probably in the midst of power generation.

Further, there is a request for downsizing and thinning in an electronic timepiece and downsizing is also requested to a storage mechanism. Therefore, energy stored to the storage mechanism is reduced, a time period capable of maintaining operation of a timepiece circuit by energy of the storage mechanism is shortened and a probability of causing stoppage of the timepiece circuit becomes high. In order to reduce danger of stoppage of operation, power consumption of the timepiece circuit needs to reduce when a thermoelectric element does not generate electricity.

Further, it is preferable to inform stoppage of power generation to a user when the thermoelectric element stops generating electricity. Further, it is also preferable to inform a user that a remaining amount of energy of the storage mechanism is reduced. Further, it is preferable to carry out the display in a state in which power consumption is reduced more than in normal display.

SUMMARY OF THE INVENTION

As means for resolving the above-described problem, an electronic timepiece having a thermoelectric element according to the present invention is installed with a thermoelectric element, a storage mechanism for storing an electromotive force of the thermoelectric element or storing a power produced by boosting an output from the thermoelectric element by a booster circuit, an oscillating circuit, a frequency dividing circuit or a time information calculating circuit, a display driving circuit, a display unit and in addition thereto, a power monitoring circuit for monitoring a situation of at least either one of generated power and stored energy by measuring generated voltage or current of the thermoelectric element or output voltage or current of the booster circuit or voltage of the storage mechanism, and an operation stopping circuit or a display drive controlling circuit for controlling operation of the oscillating circuit or the frequency dividing circuit or the time information calculating circuit or the display driving circuit by a detected output of the power monitoring circuit. When the power monitoring circuit detects stoppage of power generation of the thermoelectric element or a deficiency in stored energy of the storage mechanism, in order to reduce power consumed in the electronic timepiece, operation of the oscillating circuit, the frequency dividing circuit or the time information calculating circuit or the display driving circuit is controlled by an ON/OFF control by the display drive controlling circuit or the operation stopping circuit.

Further, in the case of a timepiece in a so-to-speak analog display using motors, a wheel train and hands as a displayer, in a constitution having a motor for a hour hand and a minute hand and a motor for a second hand, when the power monitoring circuit detects lowering of at least either one of generated power and stored energy, the lowering is informed to a user by stopping only the motor for the second hand and power consumption is reduced.

Further, when the power monitoring circuit detects lowering of generated power, there is provided a counting circuit for counting a time period of duration of the lowering and when there is no power generation for a long period of time, operation of a timepiece circuit including the oscillating circuit is stopped and dissipation of a battery is prevented.

BRIEF DESCRIPTION OF THE DRAWINGS

A preferred form of the present invention is illustrated in the accompanying drawings in which.

DETAILED DESCRIPTION OF THE PREFERRED EMBODIMENTS

An explanation will be given of a first embodiment of an electronic timepiece having a thermoelectric element according to the present invention in reference to a block diagram of FIG. 1.

Figure 2:
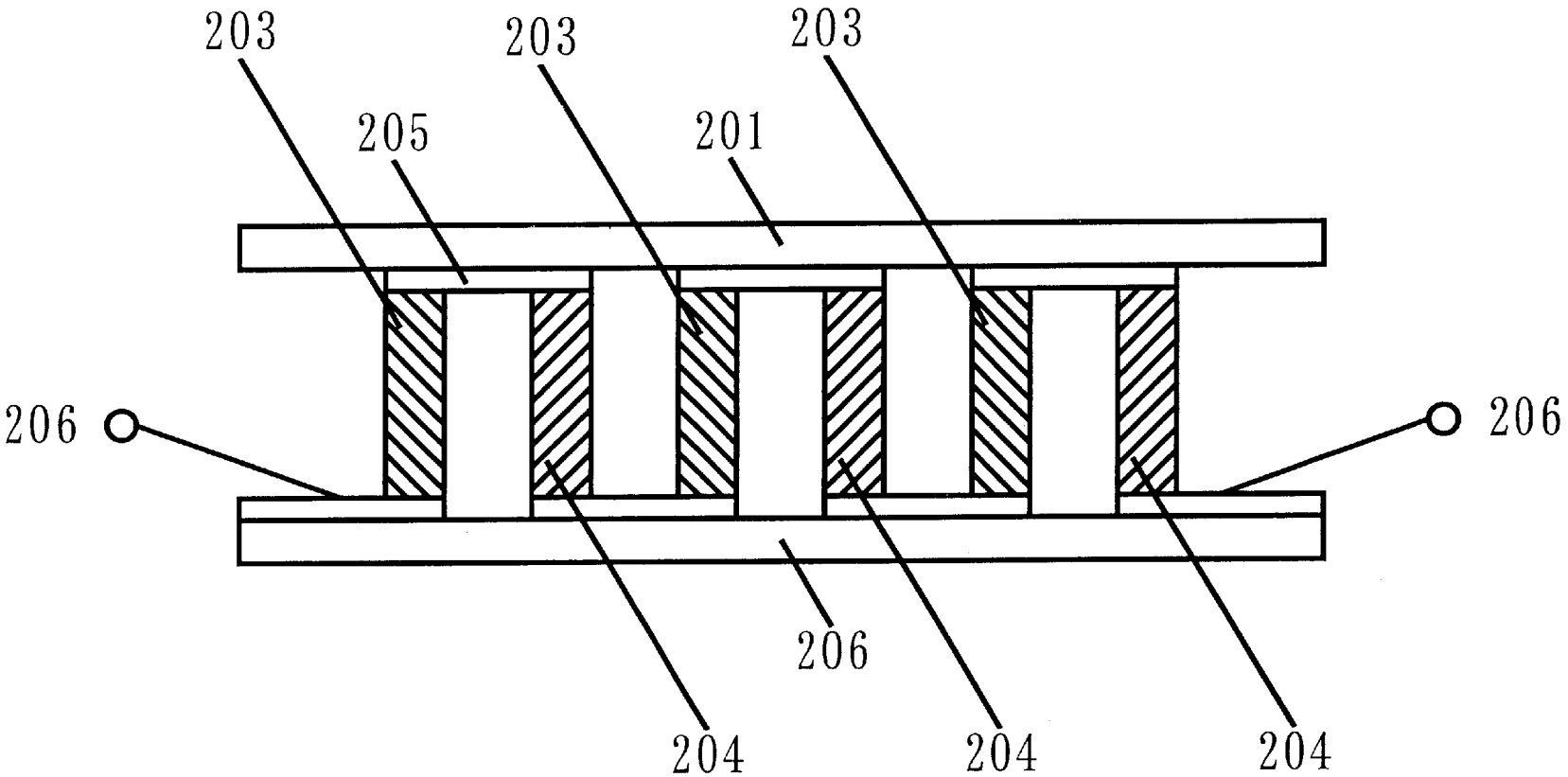
FIG. 2 is a view of a structure of a thermoelectric element used in a conventional electronic timepiece having a thermoelectric element.

The thermoelectric element 101 is similar to that in the conventional case and is provided with a structure shown by the structural view of FIG. 2. In respect of generated voltage of the thermoelectric element 101, in the case in which a material of Bi—Te-base is used for the n-type semiconductors 203 and the p-type semiconductors 204 constituting the thermoelectric element 101, the numbers of the p-type/the n-type are respectively 1000 and a temperature difference of 2° C. is constituted between the heat absorbing side substrate 202 and the heat radiating side substrate 201, and an output of about 0.8 V is provided under no load. However, when a load is connected, the voltage is lowered to about 0.4 V.

The generated voltage of 0.4 V is transmitted to a booster circuit 102. The inside of the booster circuit 102 is divided into a booster unit 111 and a reverse current preventing unit 112 and the booster unit 111 is constituted by a charge pump using a condenser or by using the counter electromotive force of a coil, carries out boosting of about 4 times and provides an output of about 1.5 V. The output at 1.5 V is transmitted and stored to the storage mechanism 103 via the reverse current preventing unit 112. The reverse current preventing unit 112 is for preventing generation of wasteful power consumption by reversely flowing stored energy of the storage mechanism 103 to the booster unit 111 when the thermoelectric element 101 does not generate electricity.

As the storage mechanism 103, although, for example, a lithium secondary battery, a carbon-lithium secondary battery, a vanadium-lithium secondary battery or a large capacity condenser of an electric double layer condenser or the like can be used, in this case, a lithium secondary battery of 1.5 V series is used.

The timepiece unit 110 is provided with a constitution similar to that in the conventional example and is constituted by the oscillation or oscillating circuit 105, the frequency dividing circuit 106, the display driving circuit 107 for driving a step motor for display and the display unit 108 comprising step motors, a wheel train and display hands. The storage mechanism 103 is connected to the timepiece unit 110 as power source therefor and energy is supplied from the storage mechanism 103 to the timepiece unit 110 even when the thermoelectric element 101 does not generate electricity. When sufficient energy is charged, the storage mechanism 103 is provided with voltage of about 1.5 V by which the timepiece unit 110 is operated and time is displayed. In this case, the time unit 110 is designed to operate about 0.9 V or higher.

When the timepiece is not mounted to the arm, heat is not conducted to the heat absorbing side substrate 202 of the thermoelectric element 101 and therefore, no electromotive force is generated at the thermoelectric element 101, power of the booster unit 111 is also lowered and a power monitoring circuit 104 compares the output from the booster unit 111 with threshold voltage. The threshold voltage is generated at inside of the power monitoring circuit 104 and is set to, for example, 0.9 V. When the output is determined to be equal to or lower than the threshold voltage by the voltage comparison, the power monitoring circuit 104 outputs a signal to a display drive controlling circuit 109 and the display drive controlling circuit 109 cuts power source of the display driving circuit 107 or forcibly switches an output driver to an OFF state to thereby stop operation of the display driving circuit 107 by which the step motors included in the display unit 108 are also stopped and a second hand, a minute hand and an hour hand connected to the motors by the wheel train are also stopped. Thereby, consumed current is reduced, dissipation of energy of the storage mechanism 103 is reduced, the voltage of the storage mechanism 103 can be maintained at about 1.0 V highly probably and danger of exhausting the energy of the storage mechanism 103 can extremely be reduced.

Thereafter, when the timepiece is mounted again to the arm, the thermoelectric element 101 starts generating electricity and when the output from the booster unit 111 exceeds 0.9 V, the power monitoring circuit 104 instructs the display drive controlling circuit 109 to release stoppage of operation of the display driving circuit 107 and operation of the timepiece is restarted. Further, electricity is charged from the thermoelectric element to the storage mechanism 103. When the storage mechanism 103 is exhausted, a long period of time is needed to charge the storage mechanism 103 to voltage of 1.0 V by which the timepiece unit 110 can be operated. However, the possibility of exhausting the storage mechanism 103 is extremely small according to the constitution of FIG. 1 and operation of the timepiece can immediately be started.

Further, although the power monitoring circuit 104 carries out generation of the threshold voltage and voltage comparison, consumption of current is comparatively large normally in these operations and there is a case in which these operations are intermittently carried out at pertinent time intervals to reduce power consumption.

Further, in the case in which the numbers of the n-type semiconductors 203 and the p-type semiconductors 204 of the thermoelectric element 101 are respectively 2500 and a temperature difference of 2° C. is constituted between the heat absorbing side substrate 202 and the heat radiating side substrate 201, an output of about 2 V is obtained under no load. The storage mechanism 103 can be charged to 1.5 V or higher without using the booster circuit 102 and the booster circuit 102 can be omitted.

An explanation will be given of a second embodiment of an electronic timepiece having a thermoelectric element according to the present invention in reference to a block diagram of FIG. 3. The same numerals are used for portions the same as those in FIG. 1 and an explanation thereof will be omitted. A booster circuit 302 is similar to the booster circuit 102 of FIG. 1 and is provided with the booster unit 111 and the reverse current preventing unit 112. Although the timepiece unit 110 is also similar to in FIG. 1, as power source of the timepiece unit 110, a higher output of either of the output from the booster circuit 302 and the output from the storage mechanism 103 is selected and supplied by a switch mechanism 311. The switch mechanism 311 is constituted by a diode or a transistor switch and a voltage comparator. The power monitoring circuit 104 monitors the output voltage from the storage mechanism 103 which is compared with threshold voltage generated at inside of the power monitoring circuit 104 and set to, for example, 1.0 V and when the output voltage is equal to or lower than the threshold voltage, the voltage monitoring circuit 104 outputs a signal to the display drive controlling circuit 109 and the display drive controlling circuit 109 stops operation of the display driving circuit 107.

By this constitution, when energy of the storage mechanism 103 is reduced, the display drive circuit 107 stops operating, consumed current is reduced, the voltage of the storage mechanism 103 is lowered extremely gradually at 1.0 V or lower and accordingly, the possibility of exhausting the storage mechanism 103 is extremely small.

Thereafter, when the timepiece is again mounted on the arm and the thermoelectric element 101 starts generating power, the storage mechanism 103 is charged, further, the output from the booster circuit 302 is transmitted to the timepiece unit 110 and the timepiece restarts the operation. Accordingly, even when the timepiece is again detached thereafter, the operation of the timepiece can be maintained by the energy of the storage mechanism 103 and the timepiece can be prevented from stopping the operation frequently.

Figure 4:
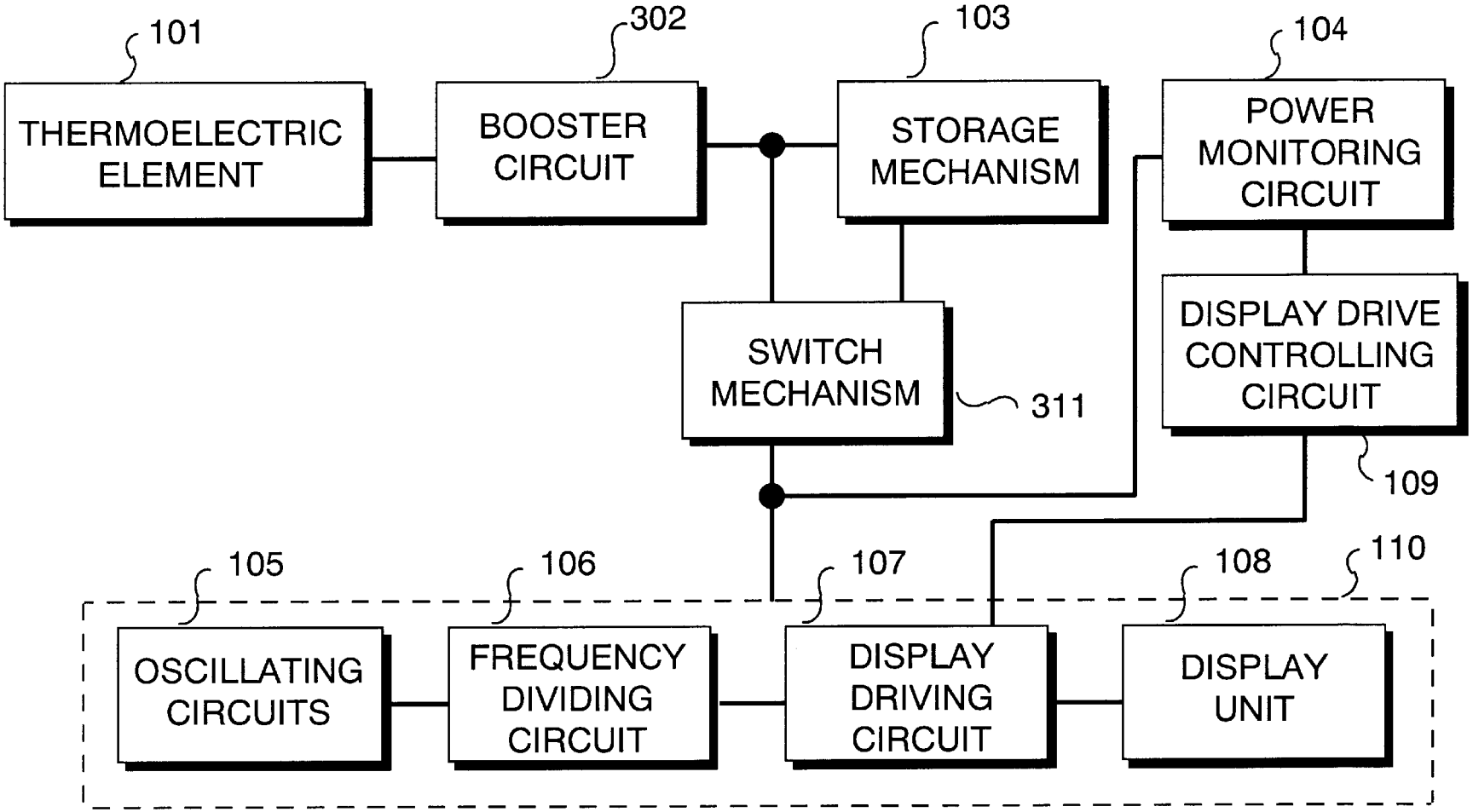
FIG. 4 is a block diagram showing another embodiment of an electronic timepiece having a thermoelectric element according to the present invention.

An explanation will be given of other embodiment of an electronic timepiece having a thermoelectric element according to the present invention in reference to a block diagram of FIG. 4.

Figure 1:
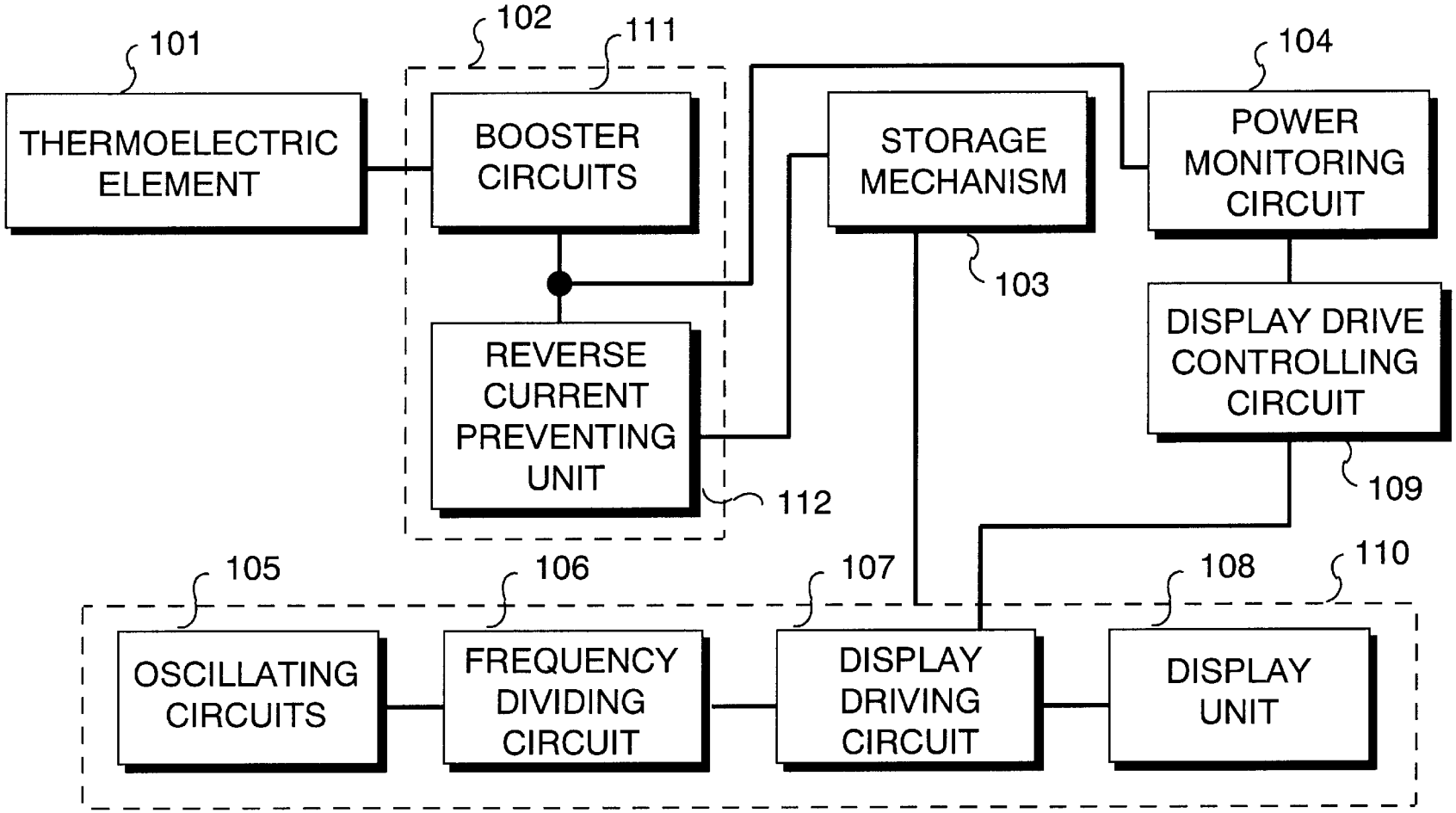
FIG. 1 is a block diagram showing a first embodiment of an electronic timepiece having a thermoelectric element according to the present invention.
Figure 3:
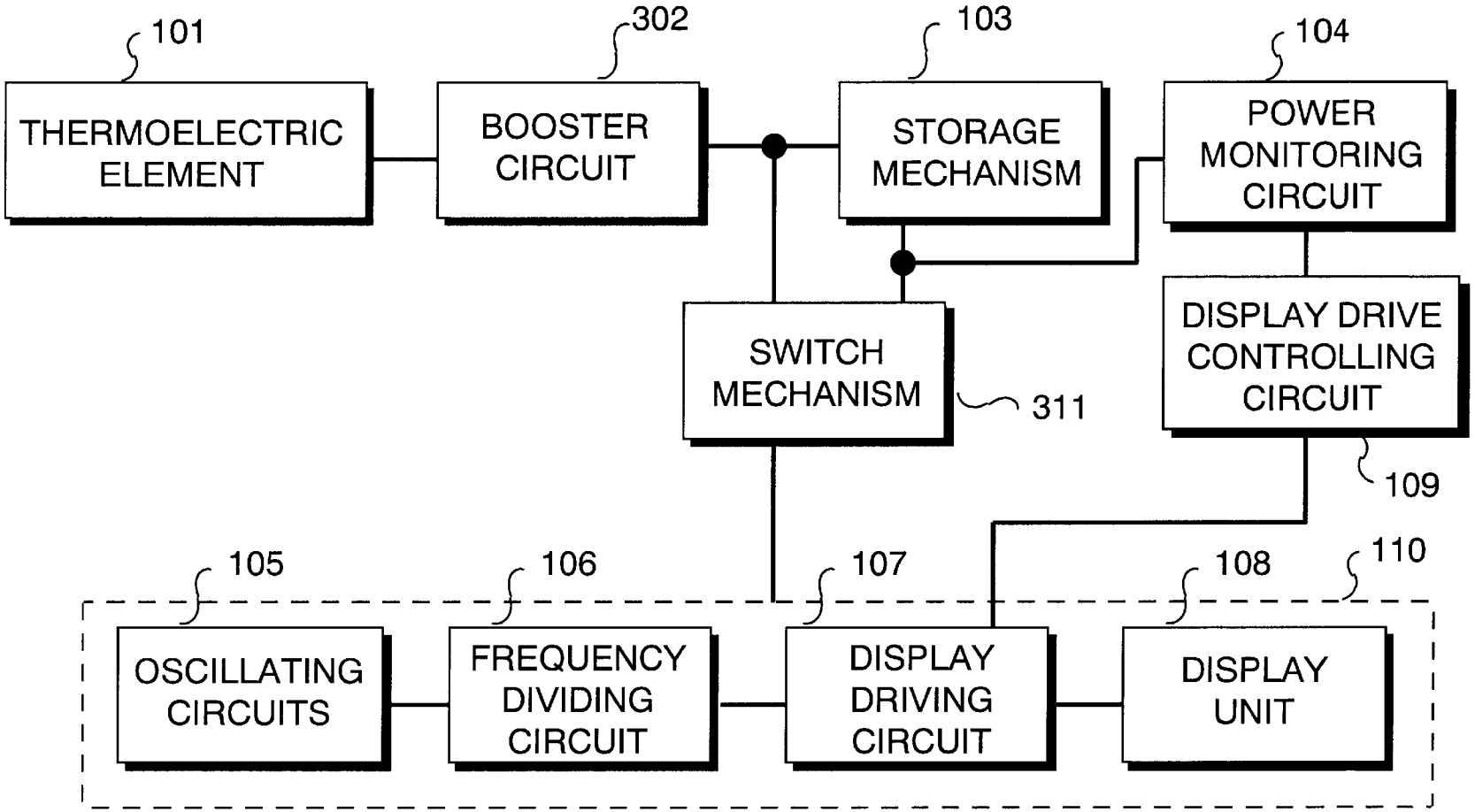
FIG. 3 is a block diagram showing a second embodiment of an electronic timepiece having a thermoelectric element according to the present invention.

The same numerals are used for portions the same as those in FIG. 1 and FIG. 3 and an explanation thereof will be omitted. As power source of the timepiece unit 110, a higher output of either of the output from the booster circuit 302 and the output from the storage mechanism 103 is selected and supplied by the switch mechanism 311. The power monitoring circuit 104 monitors output voltage from the switch mechanism 311 which is compared with threshold voltage generated at inside of the power monitoring circuit 104 and set to, for example, 1.0 V and when the output voltage becomes equal to or lower than the threshold voltage, the power monitoring circuit 104 outputs a signal to the display drive controlling circuit 109 and the display drive controlling circuit 109 stops operation of the display driving circuit 107.

By the constitution, energy of the storage mechanism 103 is reduced, operation of the display driving circuit 107 is stopped when power generation of the thermoelectric element 101 is stopped, consumed current is reduced and a possibility by which the voltage of the storage mechanism 103 becomes equal to or lower than 1.0 V and the storage mechanism 103 is exhausted is extremely small.

Thereafter, when the timepiece is again mounted on the arm and the thermoelectric element 101 starts generating power, the output from the booster circuit 302 is transmitted to the timepiece unit 110, the timepiece immediately restarts operation and the storage mechanism 103 is charged.

Therefore, even when the timepiece is detached thereafter, the operation of the timepiece can be maintained by the energy of the storage mechanism 103 and the timepiece can be prevented from stopping operation frequently.

Figure 5:
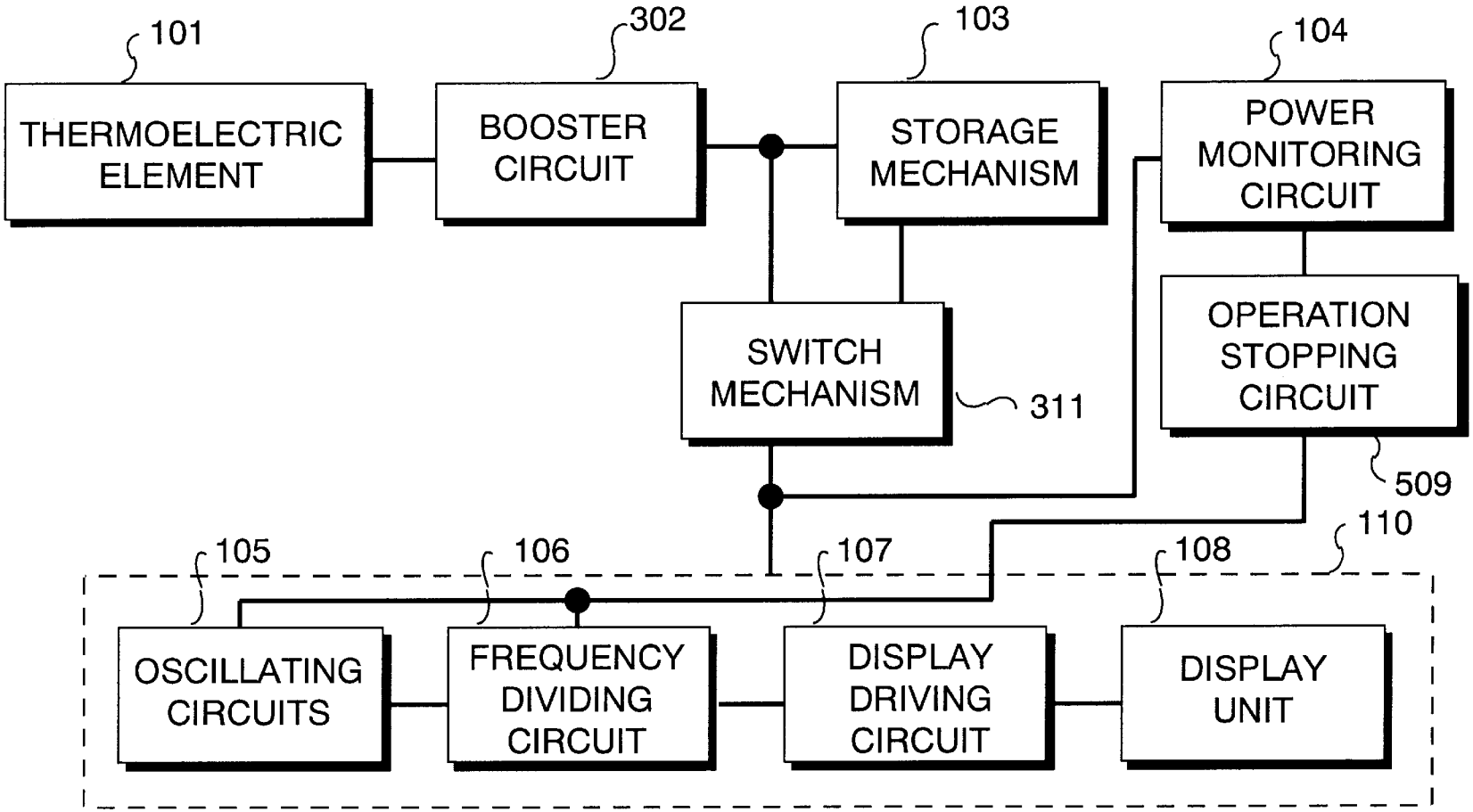
FIG. 5 is a block diagram showing another embodiment of an electronic timepiece having a thermoelectric element according to the present invention.

An explanation will be given of other embodiment of an electronic timepiece having a thermoelectric element according to the present invention in reference to a block diagram of FIG. 5. The same numerals are used for portions the same as those in FIG. 1 and FIG. 3 and an explanation thereof will be omitted. FIG. 5 shows a constitution in which in place of stopping the display in FIG. 4, oscillation operation at previous stages is stopped. The output voltage from the switch mechanism 311 is monitored by the power monitoring circuit 104 and when the power source voltage becomes equal to or lower than the threshold voltage, an operation stopping circuit 509 cuts power source of the oscillating circuit 105 and at the same time resets the frequency dividing circuit 106.

Thereby, operation of the display unit 108 is also stopped. In this case, compared with the example of FIG. 1, although time delay from when stoppage operation of the operation stopping circuit 509 is released to when the operation of the display unit 108 is recovered is prolonged, consumed current in stopping the operation is reduced and energy dissipation of the storage mechanism 103 can further be reduced.

Further, operation can also be stopped by maintaining the operation of oscillating circuit 105 and controlling only the resetting operation of the frequency dividing circuit 106.

Figure 6:
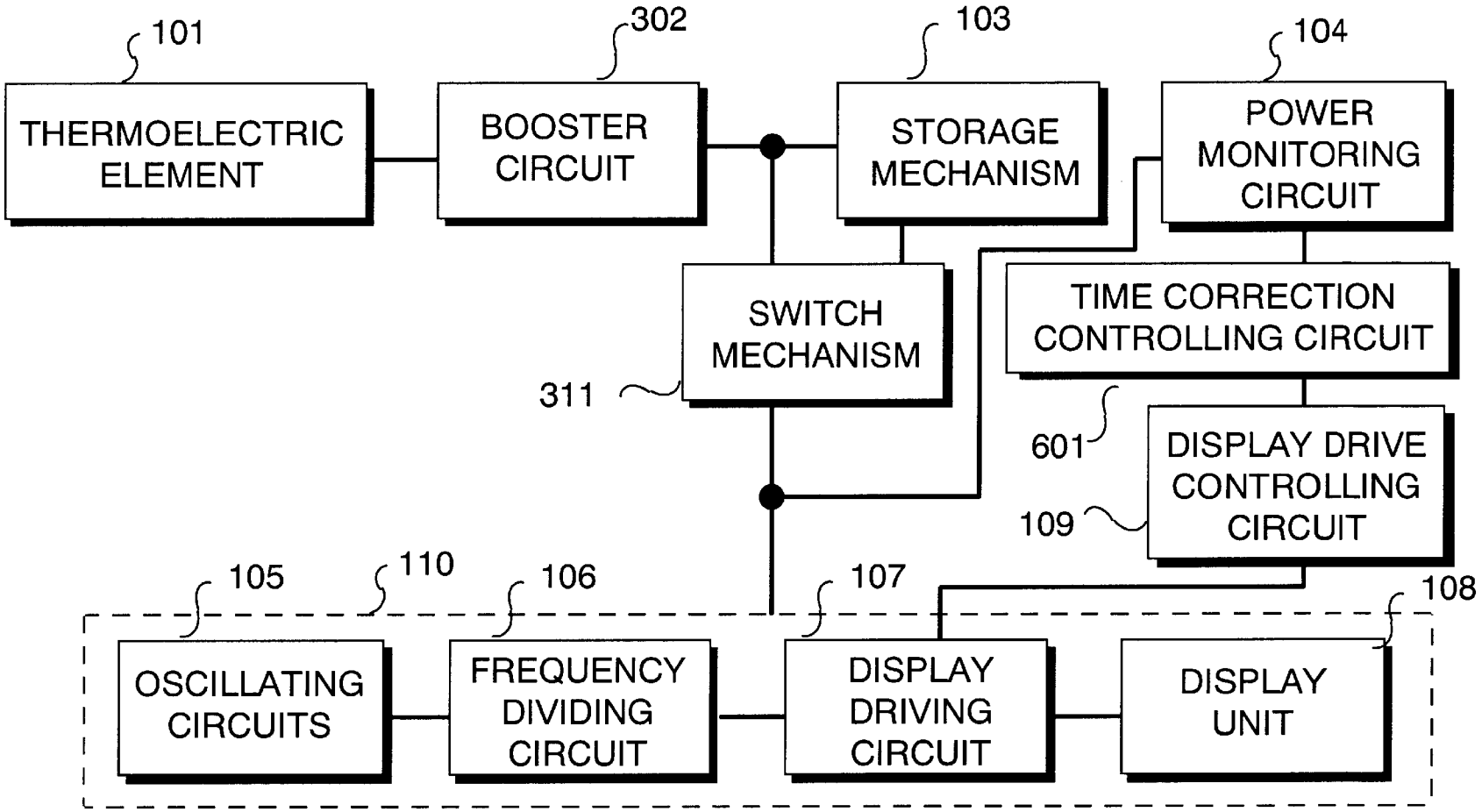
FIG. 6 is a block diagram showing another embodiment of an electronic timepiece having a thermoelectric element according to the present invention.
Figure 7:
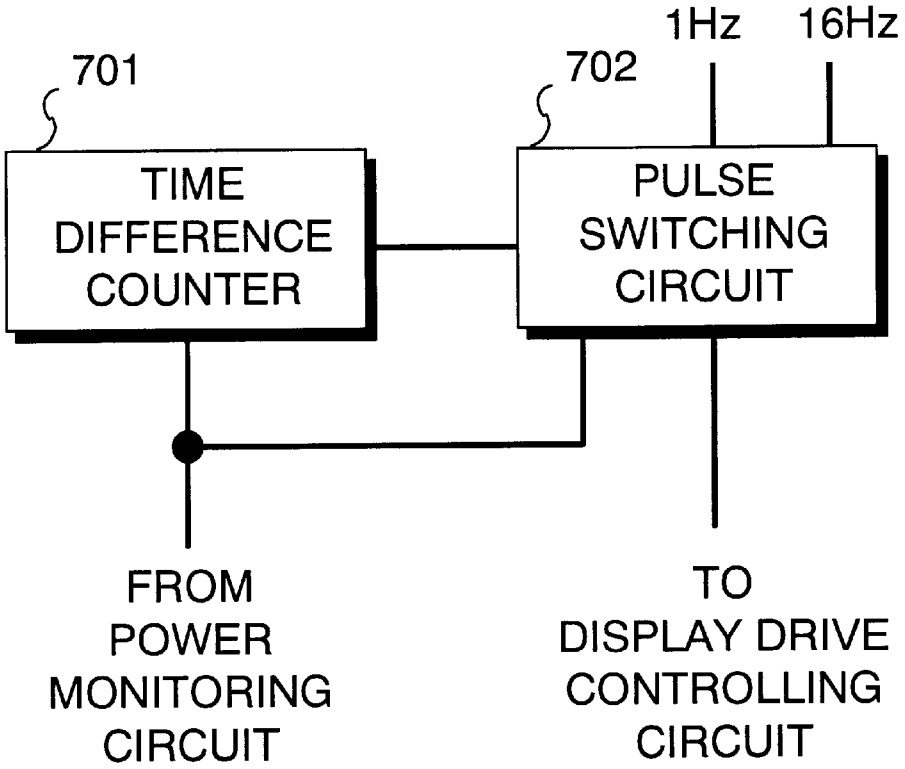
FIG. 7 is a block diagram showing an inner constitution of a time correction controlling circuit used in the embodiment of the present invention of FIG. 6.

Next, an explanation will be given of other embodiment of the present invention in reference to block diagrams of FIG. 6 and FIG. 7. The same numerals are used for portions the same as those in FIG. 4 and an explanation thereof will be omitted. There is provided a time correction controlling circuit 601 other than the constituent elements of FIG. 4. The constitution of inside of the time correction controlling circuit 601 is shown in FIG. 7, which is constituted by a time difference counter 701 and a pulse switching circuit 702. The time difference counter 701 for measuring a time difference of 12 hours at maximum is reset during a time period in which the display driving circuit 107 is operated normally and counting is stopped. However, when the display driving circuit 107 is stopped, the time difference counter 701 counts up each second pulse transmitted from the pulse switching circuit 702 and measures a stoppage duration time period of the display driving circuit 107 by a unit of second. However, although in this case, this is a counter which is reset to 0 at each 12 hours and therefore, a difference between morning and afternoon or a difference in a number of days cannot be recognized, an error of positions of time indicating hands from those of correct time can be counted.

Thereafter, when stoppage of the display driving circuit 107 is released, in place of a signal of 1 Hz at a normal time, a signal of 16 Hz is added from the pulse switching circuit 702 to the display driving circuit 107, not normal operation for moving the second hand at every second but fast feed operation of moving it by 16 steps per second is carried out. At this occasion, simultaneously with the counting up operation by second pulses, the time difference counter 701 is counted down by 1/16 second pulses of fast feed. By such an operation, the time difference counter 701 is nullified, at a time point of null, the signal of 16 Hz added to the display driving circuit 107 is recovered to the signal of 1 Hz at a normal time and the time correcting operation of the time correction controlling circuit 601 is finished. At this occasion, the indicating hands indicate correct time and time and labor for resetting time can be omitted.

Further, in respect of time correction, pertinent time correction can be carried out other than by the above-described method of fast feeding, by a method in which the indicating hands are reversely rotated, a method in which stoppage is continued until time is corrected, a method in which hand feeding is delayed by feeding by one step per 2 seconds, one step per 5 seconds or the like, or combinations of these.

Figure 8:
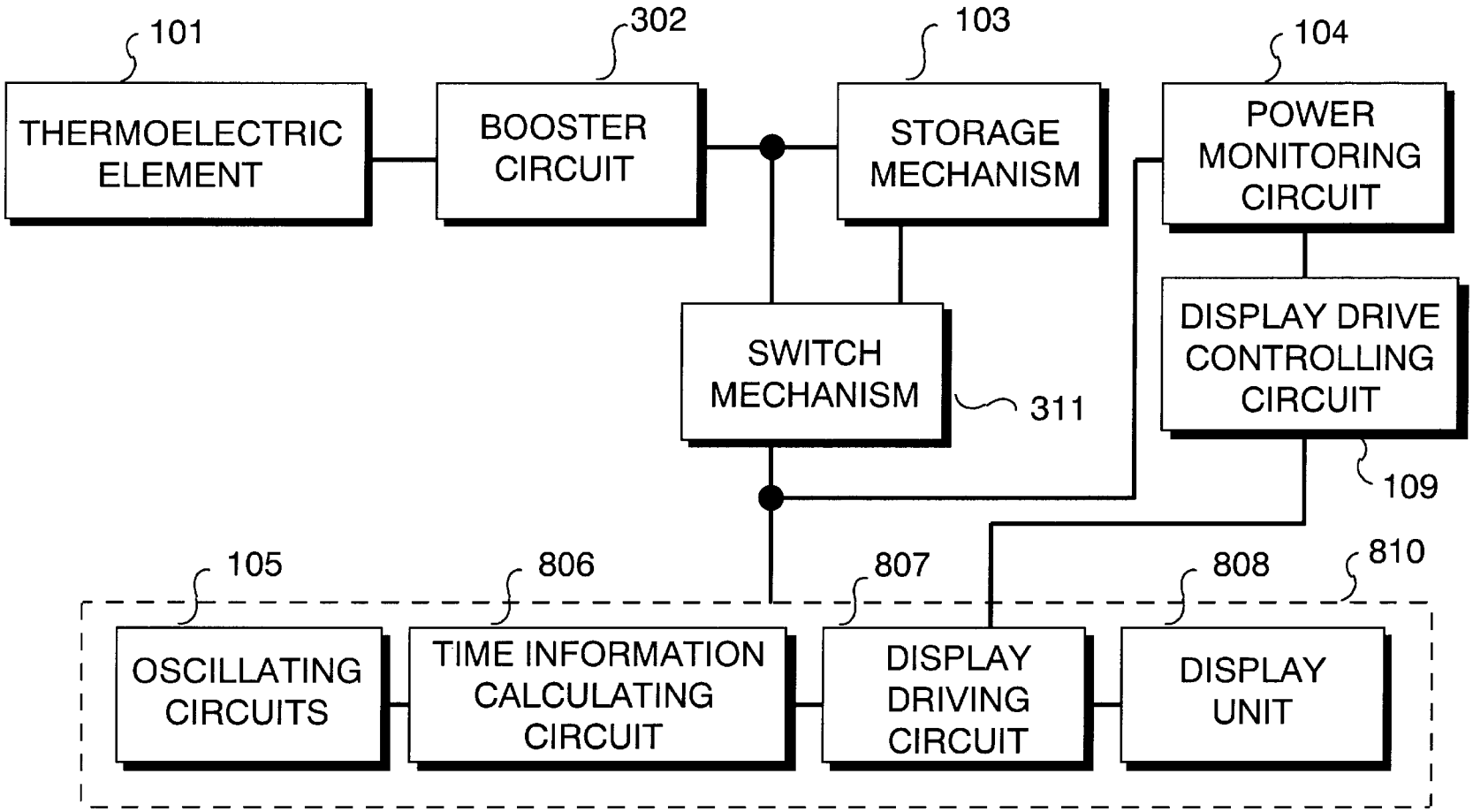
FIG. 8 is a block diagram showing another embodiment of an electronic timepiece having a thermoelectric element according to the present invention.
Figure 9:
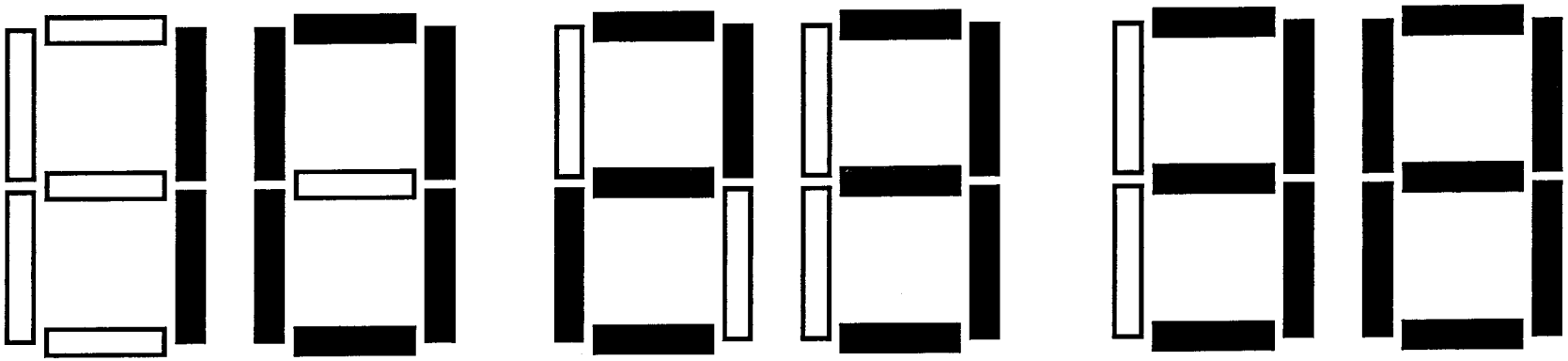
FIG. 9 is a view showing a display state of a display unit used in the embodiment of FIG. 8.

FIG. 8 is a block diagram showing still other embodiment of the present invention. The same numerals are used for portions the same as those in the above-described block diagrams and an explanation thereof will be omitted. A timepiece unit 810 is constituted by the oscillating circuit 105, a time information calculating circuit 806, a display driving circuit 807 and a display unit 808 by digital display and the time information calculating circuit 806 calculates and holds at least hour and minute information of current time. Otherwise, a constitution dealing with second, morning/afternoon, day of week, day, month and year information is feasible. FIG. 9 shows an example in which 10 o'clock, 23 minutes, 38 seconds is displayed by 7 segments display and as a display method other than the above-described, display schematically showing analog display by display hands is also feasible. As display devices, a liquid crystal displayer, an LED (light emitting diode) displayer and so on are used. The power monitoring circuit 104 monitors power source voltage of the timepiece unit 810 and when the power source voltage becomes equal to or lower than a threshold value, the display drive controlling circuit 109 cuts power source of the display driving circuit 807 or forcibly switches an output driver to an OFF state, operation of the display driving circuit 807 is stopped and display of the display unit 808 is extinguished. However, the time information calculating circuit 806 continues operating and time information is continued being counted accurately. Accordingly, when the power source voltage of the timepiece unit 810 is recovered and the power monitoring circuit 104 and the display drive controlling circuit 109 release stoppage of operation of the display driving circuit 807, correct time is displayed at the display unit 808.

Figure 10:
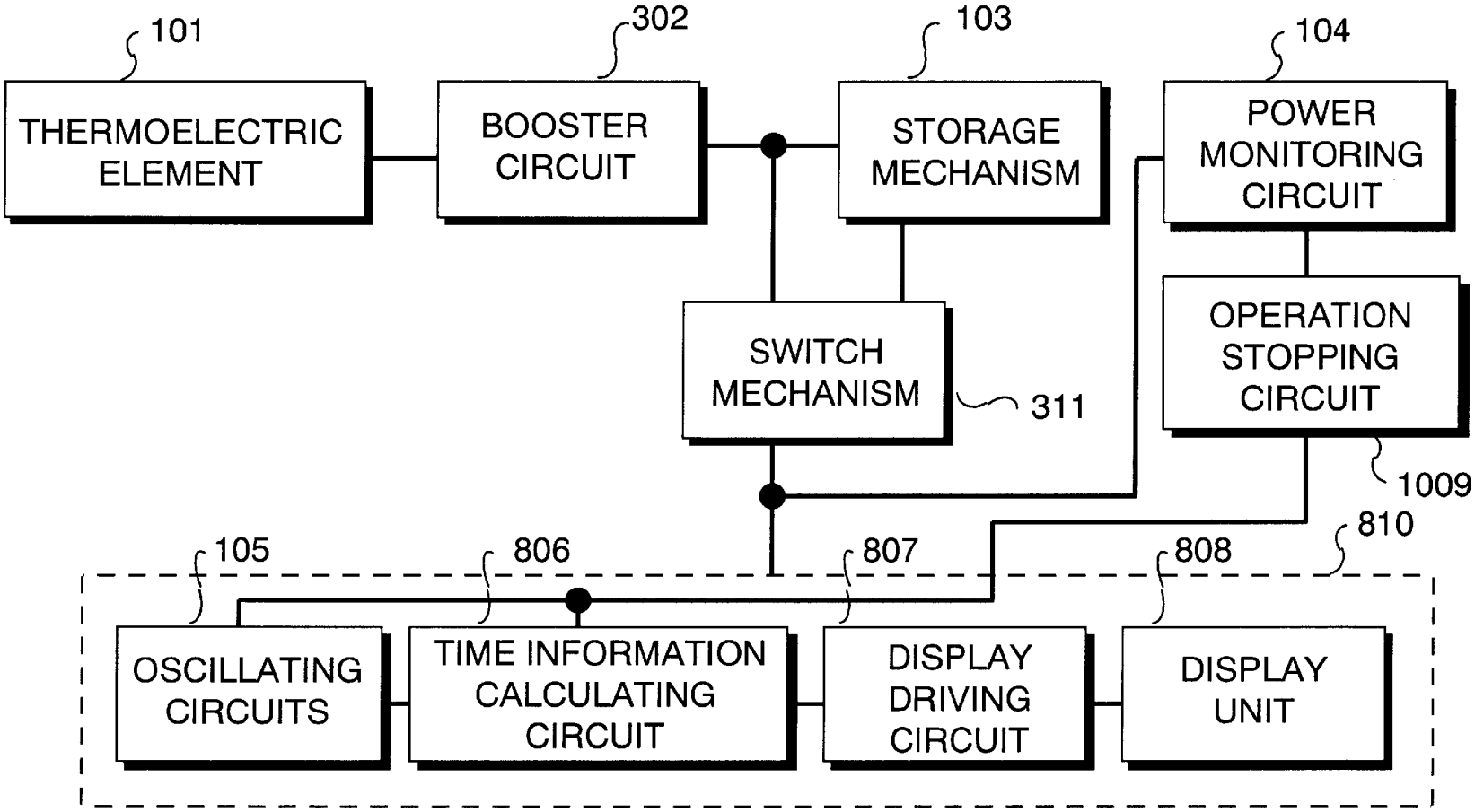
FIG. 10 is a block diagram showing another embodiment of an electronic timepiece having a thermoelectric element according to the present invention.

FIG. 10 shows an embodiment according to the present invention having a constitution in which the operation of the oscillating circuit 105 or the time information calculating circuit 806 is stopped by using an operation stopping circuit 1009 in place of the display drive controlling circuit 109 of FIG. 8. The display unit 808 of FIG. 10 uses digital display similar to FIG. 8, the power source voltage of the timepiece unit 810 is monitored by the power monitoring circuit 104 and when the power source voltage becomes equal to or lower than the threshold value, the operation stopping circuit 1009 cuts the power source of the oscillating circuit 105 or stops operation of the time information calculating circuit 806. Thereby, display of the display unit 808 is extinguished. In this case, compared with example of FIG. 8, although time resetting is needed since time information is extinguished, consumed current in stopping the operation can be reduced and energy dissipation of the storage mechanism 103 can be reduced.

Further, a constitution in which two of threshold values of the power monitoring circuit 104 are provided, the display driving circuit 807 is stopped at time point at which the power source voltage of the timepiece unit 810 becomes equal to or lower than a higher one of the threshold values and when the voltage is further lowered to be equal to or lower than a lower one of the threshold values, operation of the oscillating circuit 105 or the time information calculating circuit 806 is stopped, is also feasible.

An explanation will be given of other embodiment of an electronic timepiece having a thermoelectric element according to the present invention in reference to a block diagram of FIG. 11. The same numerals are used for portions the same as those in the above-described block diagrams and an explanation thereof will be omitted. The generated output from the thermoelectric element 101 is boosted by the booster circuit 302 and the output from the booster circuit 302 is transmitted and stored to the storage mechanism 103. A timepiece unit 1110 is constituted by the oscillating circuit 105, the frequency dividing circuit 106, a motor driving circuit 1107, a first motor 1108, a second motor 1109 and a wheel train and display hands connected to these motors and is operated as a three hands timepiece in which an hour hand, a minute hand and a second hand are normally rotated concentrically. As power source of the timepiece unit 1110, a higher output of either of the output from the booster circuit 302 and the output from the storage mechanism 103 is supplied by a diode or a transistor switch of the switching mechanism 311, the power monitoring circuit 104 monitors the power source voltage of the timepiece unit 1110 and transmits signals to a second hand position controlling circuit 1105 and a motor drive controlling circuit 1106 when the power source voltage becomes equal to or lower than a set threshold value and the motor drive controlling circuit 1106 controls operation of the motor driving circuit 1107.

The first motor 1108 is a motor for moving the hour hand and the minute hand, is normally operated by one step per 20 seconds and displays accurate hour and minute. The second motor 1109 is a motor exclusive for the second hand and operation/stoppage thereof is controlled as necessary. In a normal state in which the power source voltage of the timepiece unit 1110 is equal to or larger than the threshold value, the second hand displays accurate second and is rotated by one step per second. Next, when the power source voltage of the timepiece unit 1110 becomes equal to or lower than the set threshold value, the power monitoring circuit 104 transmits voltage drop signals to the second hand position controlling circuit 1105 and the motor drive controlling circuit 1106, the second hand position controlling circuit 1105 prepares for stopping the second motor 1109 and soon the second hand stops in the 12 o'clock direction at a reference second position. Thereafter, when the power source voltage of the timepiece unit 1110 is recovered, the second hand position controlling circuit 1105 prepares for moving the second motor 1109 and after a while, movement of hand is restarted and correct second is displayed.

Next, a detailed explanation will be given of operation of the second hand position controlling circuit 1105. The second hand position controlling circuit 1105 is provided with a second difference counter of 60-adic and a hand position counter of 60-adic and in a normal state in which the second motor 1109 carries out second display, the second difference counter is reset and maintains count 0. Meanwhile, the hand position counter counts each second pulse and counts a display position of the second hand. When a voltage lowering signal is supplied from the power monitoring circuit 104, normal movement of hand is continued until the hand position counter becomes 0 and when the hand position counter becomes 0 and the second hand is disposed at the reference second, the operation of the motor driving circuit 1107 in respect of the second motor 1109 is stopped via the motor drive controlling circuit 1106 and the second hand is stopped. At the time point, resetting of the second difference counter is released and counting of each second pulse is started. Thereby, the second difference counter counts a difference between correct second and the second hand position. When the power source voltage of the timepiece unit 1110 is recovered and the voltage lowering signal from the power monitoring circuit 104 is not supplied, counting of the second difference counter is continued while stopping the second hand. Further, when the second difference counter becomes null, movement of the second motor 1109 is restarted, counting of the hand position counter is also restarted, the second difference counter is reset and counting is stopped. Thereby, the second hand displays correct time. As a method of correcting the second hand, other than the above-described method of awaiting the correct time, a time period from recovery of the power source voltage to starting to move the motor and a time period of correcting the second hand can be shortened by reversely rotating the second hand, by feeding the second hand fastly by 8 steps per second, by feeding the second hand slowly by one step per 2 seconds, or by combining them.

In this way, when the power source voltage is lowered, by stopping the second hand at the reference second, a user is informed of the fact that energy of the storage mechanism 103 is dissipated and is expedited to increase a power generation amount of the thermoelectric element 101 consciously. Simultaneously therewith, by stopping the second hand, power consumption can be saved. When the above-described operation is not normally operated, in almost all the cases, the second hand is stopped at a position other than the reference second and a user is informed of abnormality and is expedited to deal with it pertinently.

Further, there can be constructed a constitution in which the power monitoring circuit 104 monitors both of the output voltage of the booster circuit 302 and the voltage of the storage mechanism 103 separately, when the output voltage of the booster circuit 102 is lowered, the second hand is stopped in the 12 o'clock direction and at the reference second position and when the voltage of the storage mechanism 103 is lowered, the second hand is stopped in the 6 o'clock direction. Thereby, the power generation and electricity storage situation can be informed to a user in a finely specified manner.

Further, there can be constructed a constitution in which three stages of an amount of storing electricity are detected in accordance with the voltage of the storage mechanism 103, when the amount of storing electricity is small, the second hand is stopped in the 12 o'clock direction, when the amount of storing electricity is medium, the second hand is stopped in the 3 o'clock direction and when the amount of storing electricity is large, the second hand is stopped in the 6 o'clock direction. These constitutions are also included in the present invention.

Figure 12:
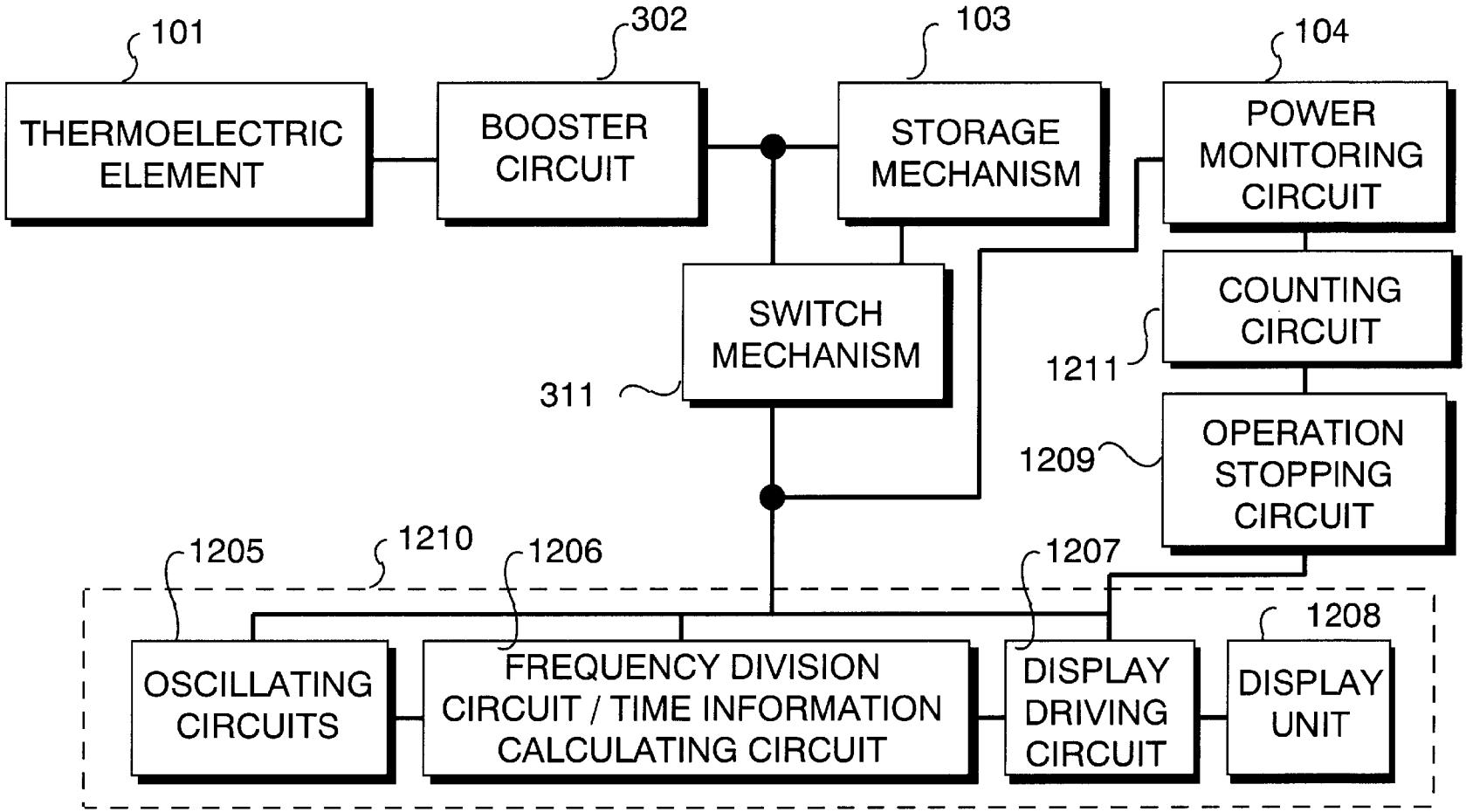
FIG. 12 is a block diagram showing another embodiment of an electronic timepiece having a thermoelectric element according to the present invention.

An explanation will be given of other embodiment of an electronic timepiece having a thermoelectric element according to the present invention in reference to a block diagram of FIG. 12. The generated power from the thermoelectric element 101 is boosted by the booster circuit 302 and the output from the booster circuit 302 is transmitted and stored to the storage mechanism 103. A timepiece unit 1210 carries out time display by an oscillating circuit 1205, a frequency division circuit/a time information calculating circuit 1206, a display driving circuit 1207 and a display unit 1208, a higher output of either of the output from the booster circuit 302 and the output from the storage mechanism 103 is supplied by a diode or a transistor switch of the switching mechanism 311 as the power source, the output voltage of the switching mechanism 311 is monitored by the power monitoring circuit 104, when the output voltage is equal to or lower than a set threshold value, a duration time period of voltage lowering is measured by a counting circuit 1211 and when the duration time period reaches a constant time period, for example, one week, an operation stopping circuit 1209 stops operation of the oscillating circuit 1205 or the frequency dividing circuit/the time information calculating circuit 1206 or the display driving circuit 1207.

By such a constitution, when the timepiece is not mounted to the arm for a long period of time and no power is outputted from the thermoelectric element 1201, it is determined that the timepiece is not used for a while, operation of the timepiece unit 1210 is stopped and wasteful energy dissipation of the storage mechanism 103 is prevented.

Figure 11:
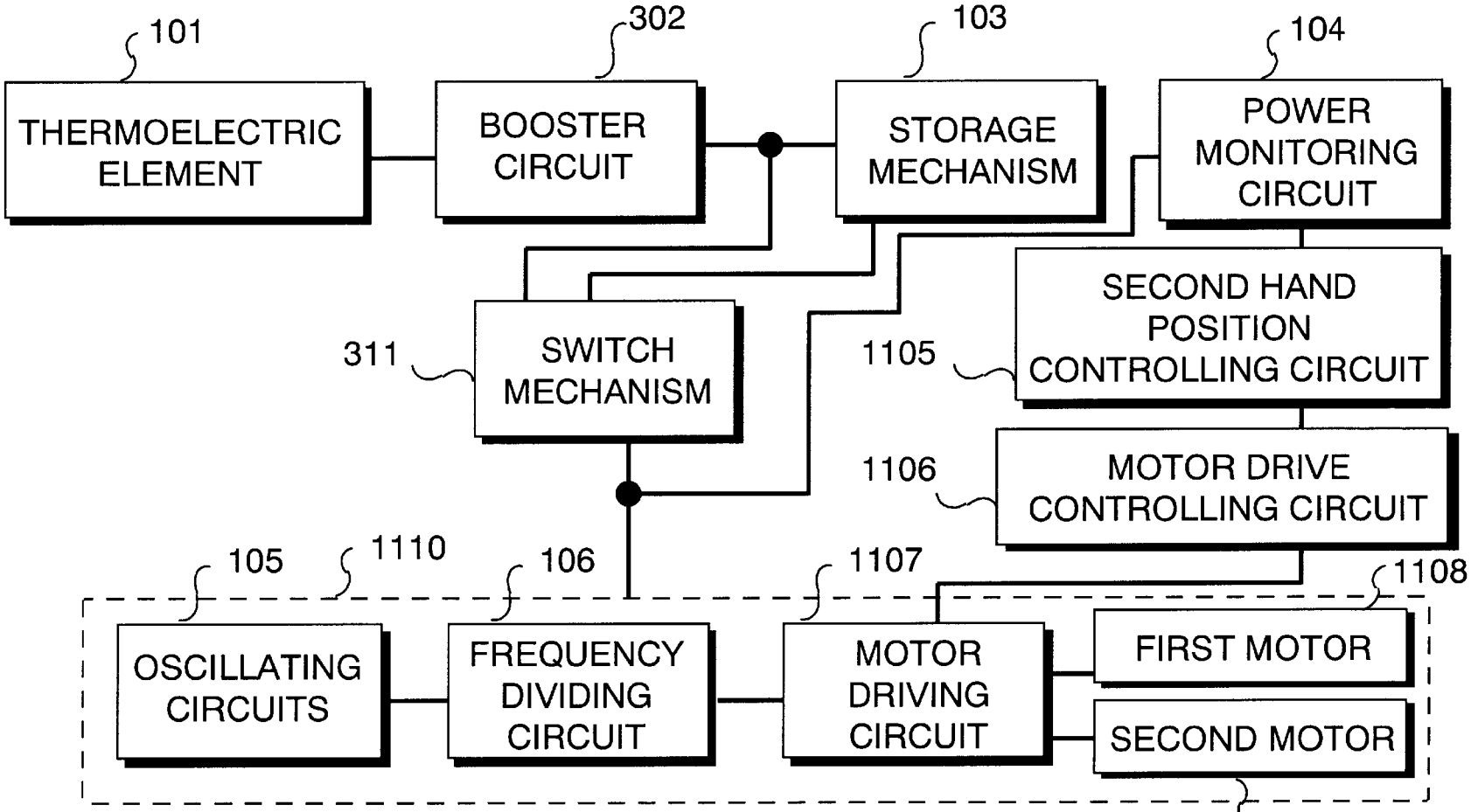
FIG. 11 is a block diagram showing another embodiment of an electronic timepiece having a thermoelectric element according to the present invention.

Further, as a combination of the above-described embodiment, there can be constructed a constitution in which when the output from the booster circuit is lowered, as in the embodiment of FIG. 11, the second hand is stopped, only hour and minute hands display is carried out, when lowering of the output from the booster circuit continues for a long period of time, the frequency dividing circuit is also stopped or a period of intermittent operation of voltage monitoring by the power monitoring circuit is prolonged to minimize power consumption.

Figure 13:
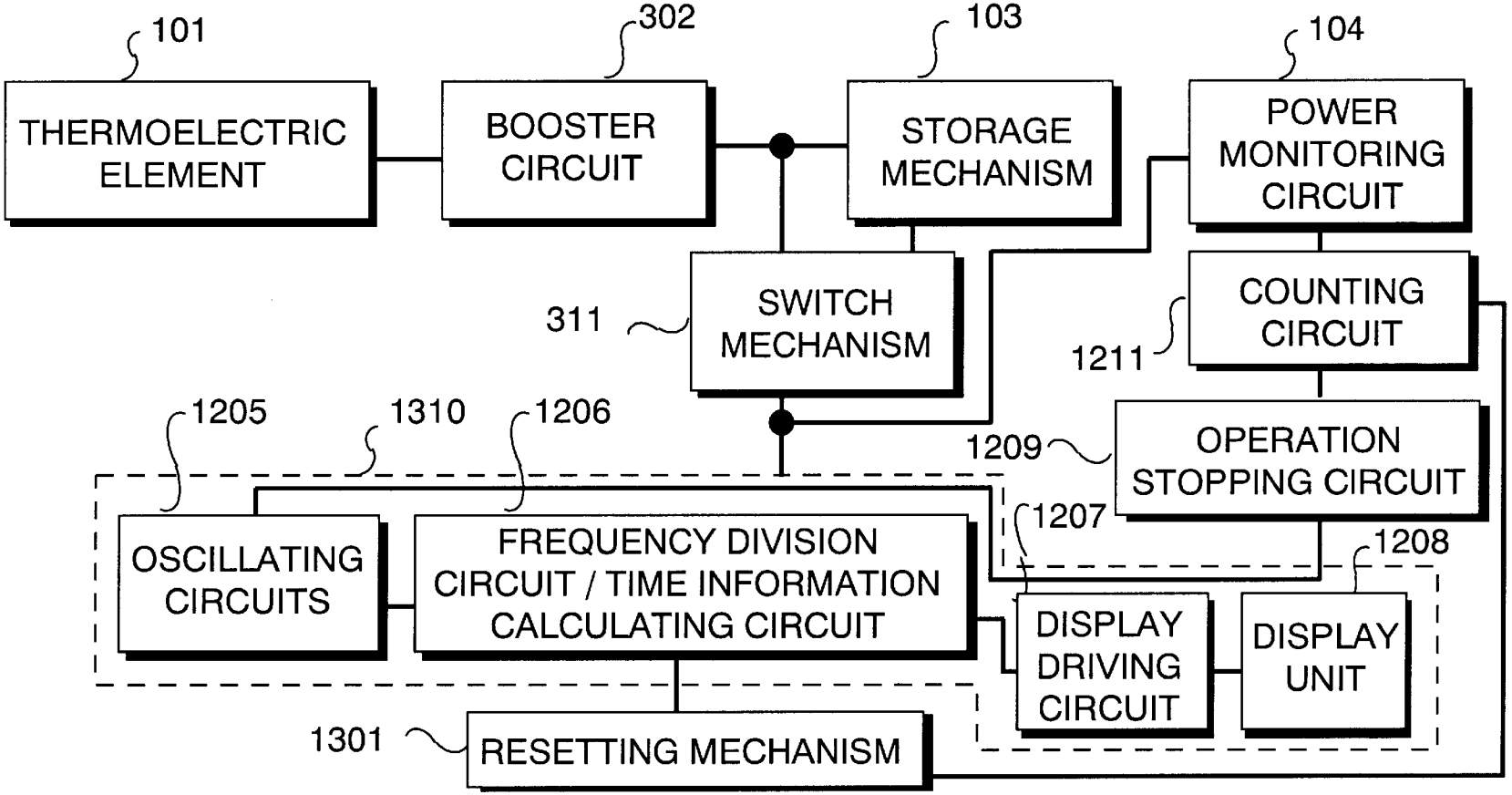
FIG. 13 is a block diagram showing another embodiment of an electronic timepiece having a thermoelectric element according to the present invention.
Figure 14:
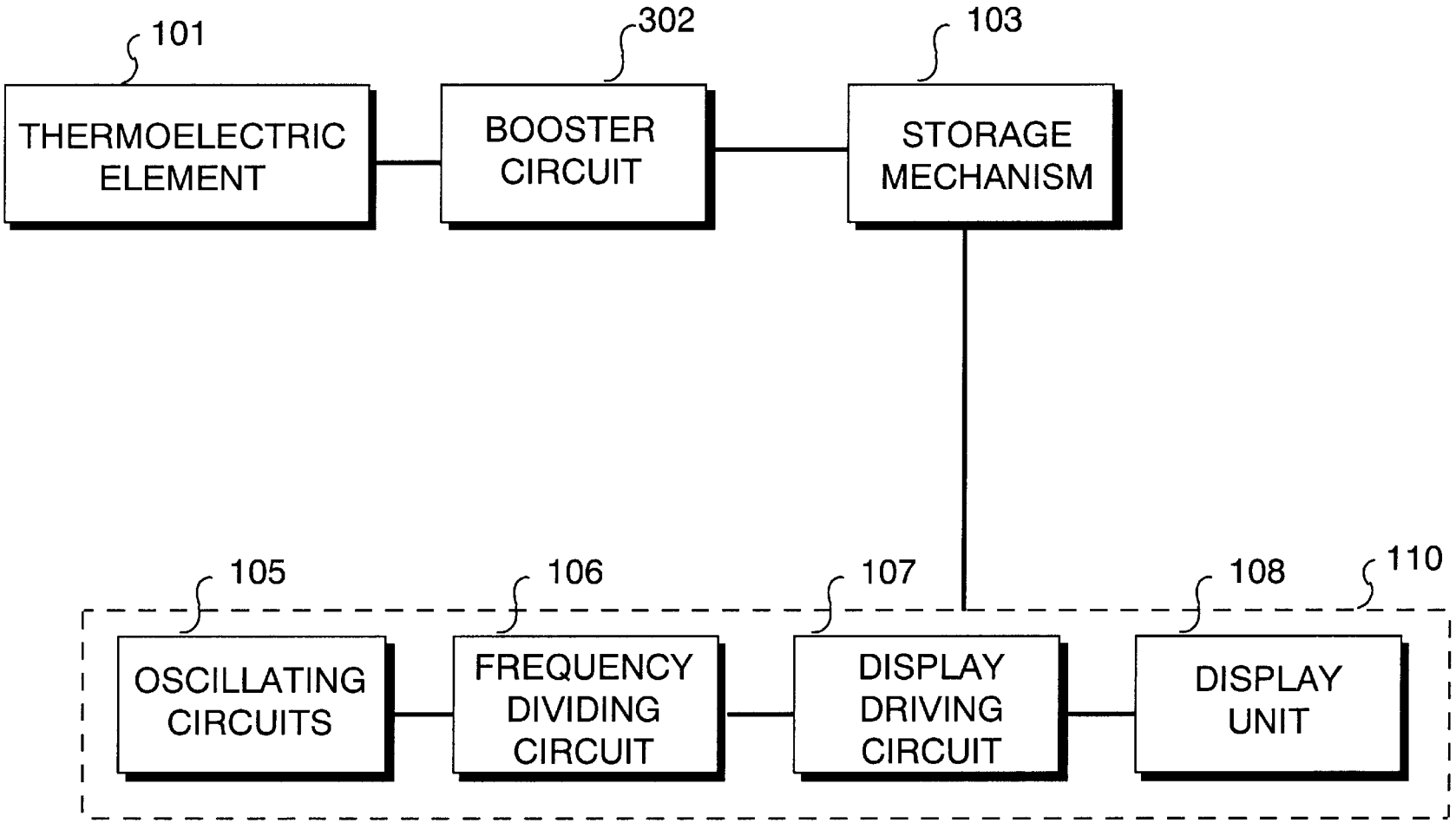
FIG. 14 is a block diagram showing a conventional electronic timepiece having a thermoelectric element.

An explanation will be given of other embodiment of the present invention in reference to a block diagram of FIG. 13. The same numerals are used for portions the same as those in the above-described block diagrams and an explanation thereof will be omitted. In this case, a frequency division resetting mechanism 1301 is added to the constitution of FIG. 12, when a situation in which the resetting mechanism 1301 is operated and the output from the booster circuit 302 is lowered, is continued for a constant time period, for example, 10 minutes, the operation of the oscillating circuit 1205 of a timepiece unit 1310 is stopped.

The resetting mechanism 1301 is operated when a crown used in correcting hands is pulled out and the hour hand, the minute hand and the second hand are stopped. The resetting mechanism 1301 is operated in correcting time, time correcting is finished for about 1 minute and resetting is released. In this case, when the oscillating circuit 1205 is also stopped, start of moving the hands after releasing the reset state is retarded.

Meanwhile, the case in which the reset mechanism 1301 is operated for a long time period and no power is generated from the thermoelectric element 101, is the case in which the timepiece is not used for a long time period, for example, a time period of inventory between fabrication and sale, which is under a situation in which dissipation of the storage mechanism 103 is intended to minimize.

Therefore, in this case, a control is carried out such that operation of circuits including the oscillating circuit 1205 and the power monitoring circuit 104 is stopped, power consumption is reduced and operation of a timepiece unit 1310 and the power monitoring circuit 104 is restarted when the crown is pushed in and the resetting mechanism 1301 is not operated. Thereby, a situation in which energy of the storage mechanism 103 is exhausted and operation of the timepiece cannot be restarted in a long period of preservation can be prevented.

Figure 15:
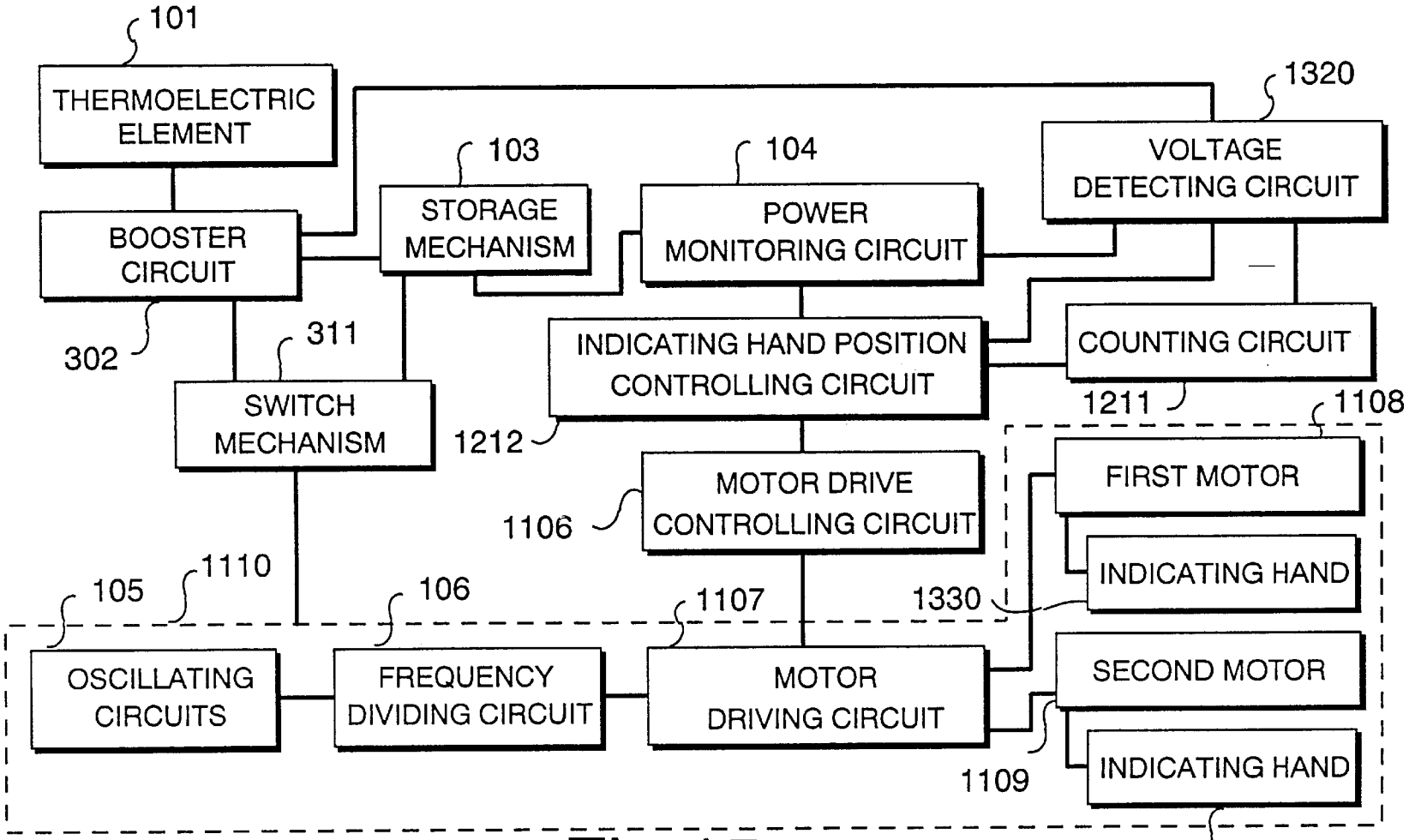
FIG. 15 is a block diagram showing other embodiment of an electronic timepiece having a thermoelectric element according to the present invention.

An explanation will be given of other embodiment of an electronic timepiece having a thermoelectric element according to the present invention in reference to a block diagram of FIG. 15.

Power generated by the thermoelectric element 101 is boosted by the booster circuit 302 and is stored in the storage mechanism 103 as boosted power. A higher power of either of the boosted power boosted by the booster circuit 302 and stored power stored in the storage mechanism 103 is supplied by a diode or a transistor switch of the switch mechanism 311 as the driving source to the timepiece unit 1110.

As the booster circuit 302, a switched capacitor system for repeating action of generating boosted voltage by charging a plurality of condensers in a parallelly connected state and switching the respective condensers into a series connection by switching elements or a system of utilizing self induction current of coil generated by opening and closing current flowing in a coil by a switching element, is suitable in downsizing it.

Further, as power generating means other than the thermoelectric element 101, a solar cell, a generator of a system using electromagnetic induction or the like, a piezoelectric generator and so on can also be used.

As an electricity storing element of the storage mechanism 103, a secondary battery of a nickel hydrogen secondary battery, a lithium ion secondary battery, a carbon lithium secondary battery, a vanadium lithium secondary battery, a lithium manganese secondary battery or the like or a large capacity condenser of an electric double layer condenser or the like can be used.

A voltage detecting circuit 1320 detects boosted power boosted by the booster circuit 302, compares it with 0.1 V which is a threshold value that is set beforehand in the voltage detecting circuit 1320 and outputs a boosted output lowering signal to the power monitoring circuit 104, an indicating hand position controlling circuit 1212 and the counting circuit 1211 when the voltage detecting circuit 1320 detects that the boosted power is less than 0.1 V.

In this case, although an explanation has bee given with the threshold value of the voltage detection circuit 1320 as 0.1V, it can be set arbitrarily within the range of the driving power source voltage of the timepiece unit 1110.

By the boosted output lowering signal outputted from the voltage detecting circuit 1320, the power monitoring circuit 104 starts operation of monitoring the stored power of the stored mechanism 103, compares it with a plurality of threshold values that are set beforehand in the power monitoring circuit 104, sets an amount of stored power stored in the storage mechanism 103 and outputs a stored power signal to the indicating hand position controlling circuit 1212. This operation consumes comparatively large consumed current and therefore, the operation may be carried out at arbitrary intervals.

The counting circuit 1211 initializes the counting circuit 1211 and starts counting operation by the boosted output lowering signal outputted from the voltage detecting circuit 1320. When three minutes that is a predetermined value of the counting circuit 1211 have elapsed, the counting circuit 1211 stops the counting operation and outputs a counting completion signal to the indicating hand position controlling circuit 1212. In this case, although an explanation has been given with a counted time period of the counting circuit 1211 as three minutes, it can be set to an arbitrary time period.

The indicating hand position controlling circuit 1212 prepared for operation by the boosted voltage lowering signal outputted from the voltage detecting circuit 1320, sets a stop position of an indicating hand 1330 by a stored power signal outputted from the power monitoring circuit 104 in accordance with the count completion signal outputted from the counting circuit 1211 and starts operation of outputting a stop position signal of the indicating hand 1330 to a motor drive controlling circuit 1106.

The motor drive controlling circuit 1106 moves the indicating hand 1330 and stops it at a predetermined position via a motor driving circuit 1107, a first motor 1108 connected to the motor driving circuit 1107 and a wheel train (not illustrated) connected to the first motor 1108 by the stop position signal of the indicating hand 1330 outputted from the indicating hand position controlling circuit 1212. In this case, the indicating hand 1330 is the second hand.

Figure 16:
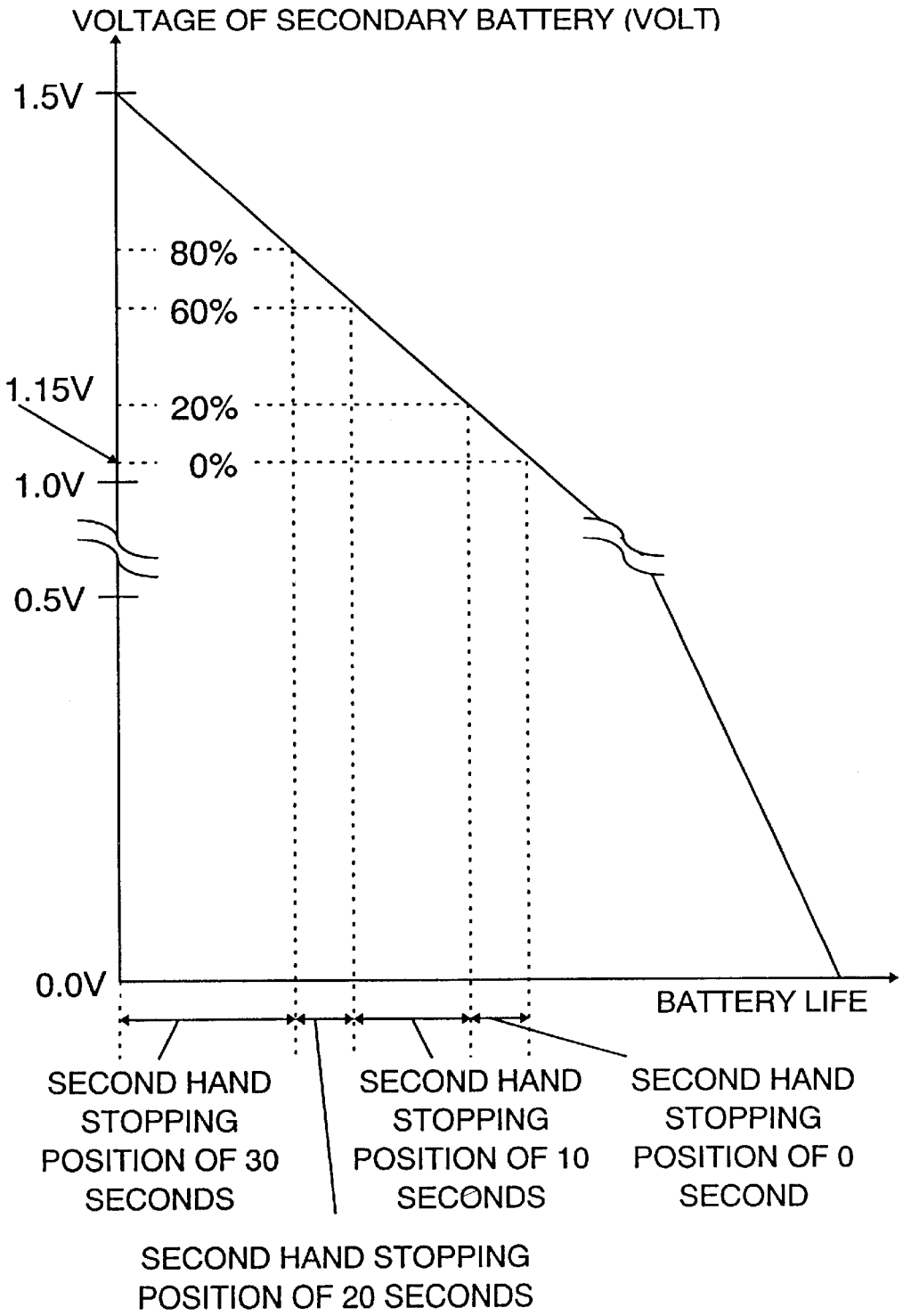
FIG. 16 is a diagram showing a relationship between stored energy of a storage mechanism and a position of stopping an indicating hand used in the embodiment of FIG. 15.

An explanation will be given of a relationship between the stored power of the storage mechanism 103 and the stop position of the indicating hand 1330 in reference to FIG. 16. FIG. 16 shows a discharge characteristic of a lithium secondary battery used in the storage mechanism 103. A nominal voltage of the lithium secondary battery of the storage mechanism 103 is set to 1.5 V, a capacity calculated from between the nominal voltage and 1.5 V (which is an example of voltage capable of sufficiently driving respective motors of the first motor 1108 moving the indicating hand 1330 and a second motor 1109 moving an indicating hand 1331 different from the indicating hand 1330) is set to 100%, voltages in correspondence with 100%, 80%, 60%, 20% and 0% are set beforehand to the power monitoring circuit 104 from the capacity and the stop position of the indicating hand 1330 is set by the stored power of the storage mechanism 103. In the case of voltage in correspondence with a section in which the stored power of the storage mechanism 103 exceeds 80% and is equal to or lower than 100%, the indicating hand 1330 is stopped at a position of 30 seconds, in the case of voltage in correspondence with a section in which the stored power exceeds 60% and is equal to or lower than 80%, the indicating hand 1330 is stopped at a position of 20 seconds, in the case of voltage in correspondence with a section in which the stored power exceeds 20% and is equal to or lower than 60%, the indicating hand 1330 is stopped at a position of 10 seconds and in the case of voltage in correspondence with a section in which the stored power exceeds 0% and is equal to or lower than 20%, the indicating hand 1330 is stopped at a position of 0 second. In this case, the stop position of the indicating hand 1330 is a position with a position of the reference second (0 second) as a reference.

Figure 17A:
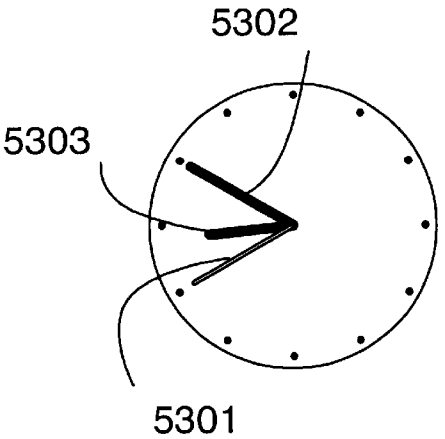
FIGS. 17A–17E shows diagrams indicating examples of positions for stopping indicating hands used in the embodiment of FIG. 15.
Figure 17B:
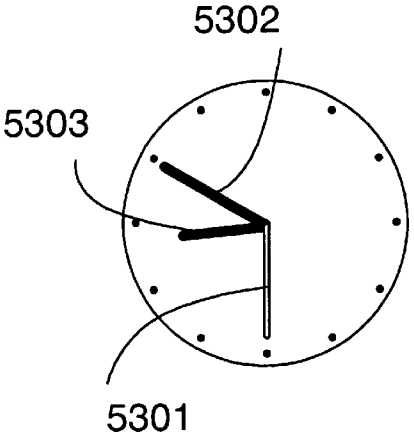
Figure 17C:
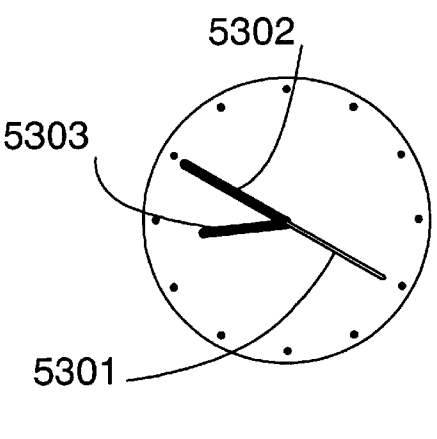
Figure 17D:
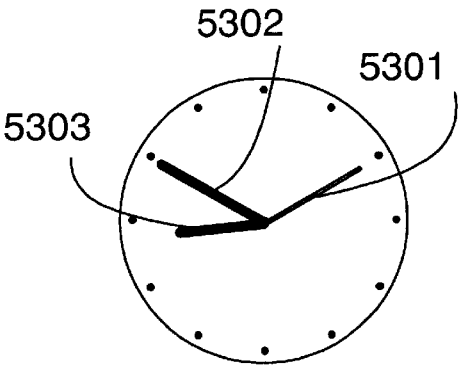
Figure 17E:
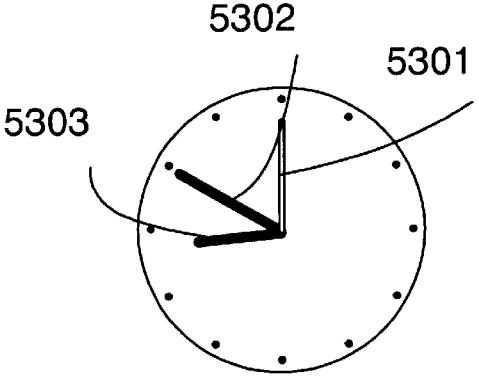

Next, an explanation will be given of the stop position of the indicating hand 1330 in reference to FIG. 17. FIG. 17A shows a state immediately after the counting circuit 1211 starts counting operation and outputs the counting completion signal to the indicating hand position controlling circuit 1212 after elapse of 3 minutes which is a predetermined value. FIG. 17B shows a state in which a second hand 5301 is stopped at a position of 30 seconds in the case in correspondence with the section where the stored power of the storage mechanism 103 exceeds 80% and is equal to or lower than 100%. FIG. 17C shows a state in which the second hand 5301 is stopped at a position of 20 seconds in the case in correspondence with the section where the stored power of the storage mechanism 103 exceeds 60% and is equal to or lower than 80%. FIG. 17D shows a state in which the second hand 5301 is stopped at a position of 10 seconds in the case in correspondence with the section where the stored power of the storage mechanism 103 exceeds 20% and is equal to or lower than 60%. FIG. 17E shows a state in which the second hand 5301 is stopped at a position of 0 second in the case in correspondence with the section where the stored power of the storage mechanism 103 exceeds 0% and is equal to or lower than 20%.

Other than these, as a stop position of the indicating hand 1330, a position of moving the indicating hand 1330 at a time point where 3 minutes which is a predetermined value have elapsed after the counting circuit 1211 started counting operation, or a position of the reference second (0 second) or the like is conceivable.

In this way, the first motor 1108 can inform a state of the stored power of the storage mechanism 103 to a user by moving the indicating hand 1330 and displaying the state of the stored power of the storage mechanism 103 although display of second time by the indicating hand 1330 is interrupted and the second motor 1109 can inform time different from second time by moving the indicating hand 1331.

The operation of displaying the state of the storage power of the storage mechanism 103 by the indicating hand 1330 is repeated at intervals of, for example, 60 seconds until the boosted power boosted by the booster circuit 302 becomes equal to or higher than 0.1 V.

An explanation will be given of other embodiment of the present invention in reference to the block diagram of FIG. 15. The same numerals are used for portions the same as those in the block diagram of the above-described embodiment and an explanation thereof will be omitted.

According to the embodiment, the counting operation which has been stopped after elapse of 3 minutes which is a predetermined value after the counting circuit 1211 started the counting operation in the above-described embodiment, is continued and after elapse of 72 hours which is a second predetermined value of the counting circuit 1211, the counting circuit 1211 outputs a second count completion signal to the indicating hand position controlling circuit 1212.

The indicating hand position controlling circuit 1212 outputs an indicating hand stop position signal for stopping the indicating hand 1331 at a predetermined position to the motor drive controlling circuit 1106 by the second count completion signal outputted from the counting circuit 1211. The indicating hand stopping position is preferably a position which is recognizable as easy as possible since it informs a user that no power is generated from the thermoelectric element 101 for a long period of time. For example, a position of reference hour and reference minute (position of 12 o'clock) is preferable.

The motor drive controlling circuit 1106 moves the indicating hand 1331 and stops it at the position of reference hour and reference minute (position of 12 o'clock) via the motor driving circuit 1107, the second motor 1109 connected to the motor driving circuit 1107 and a wheel train (not illustrated) connected to the second motor 1109 by the indicating hand stop position signal outputted from the indicating hand position controlling circuit 1212. In this case, the indicating hand 1331 is constituted by the hour hand and the minute hand moved by a wheel train (not illustrated) connected to the second motor.

Figure 18B:
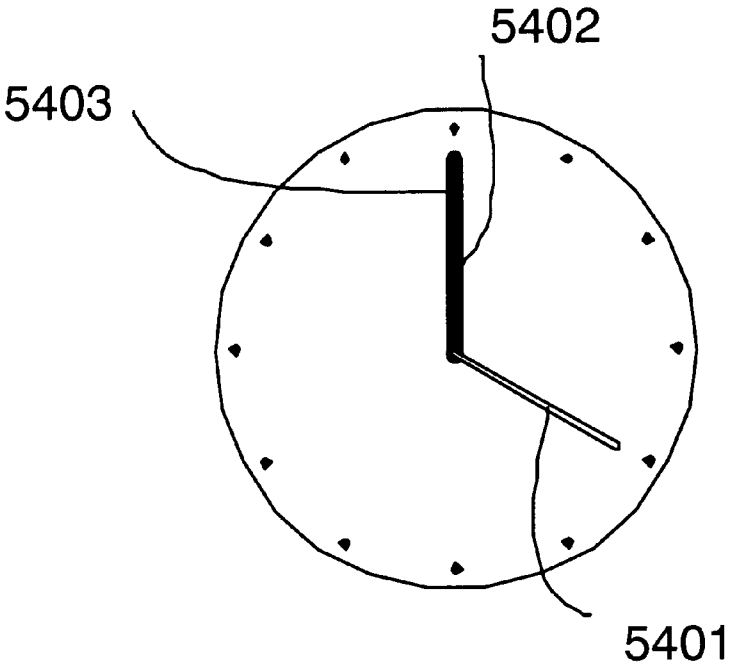
FIGS. 18A–18B shows views of examples of positions of stopping indicating hands used in other embodiment of FIG. 15.
Figure 18A:
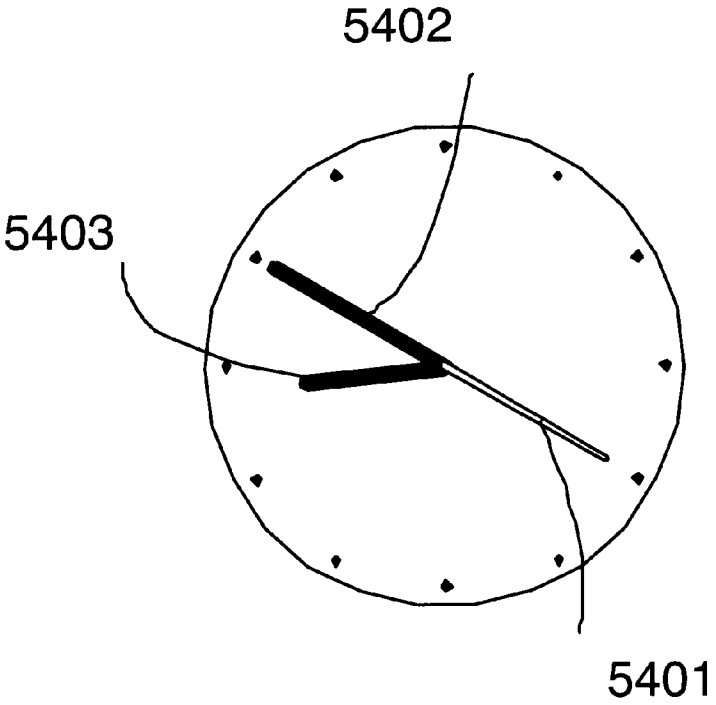

An explanation will be given of the stop position of the indicating hand 1331 in reference to FIG. 18. The same numerals are used for portions the same as those in FIG. 17. FIG. 18A shows a state immediately after 72 hours which is the second predetermined value have elapsed after the counting circuit 1211 started the counting operation. In this example, 8 o'clock and 50 minutes is shown by a minute hand 5402 and an hour hand 5403 and indicates that the stored power of the storing means 103 falls in a range of exceeding 60% and being equal to or lower than 80% by the second hand 5401. FIG. 18B shows a state in which the minute hand 5402 and the hour hand 5403 are respectively stopped at the position of reference hour and reference minute (position of 12 o'clock). Thereby, the user can be informed of the fact that no power has been generated from the thermoelectric element 101 for a long period of time.

Further, when a calendar is provided, driving of the calendar may not be interrupted after interrupting to drive the second motor 1109.

In this way, successive to the above-described embodiment, by interrupting the drive operation of the second motor 1109 for driving the indicating hand 1331, consumption of stored power of the storage mechanism 103 can further be restrained.

Figure 19:
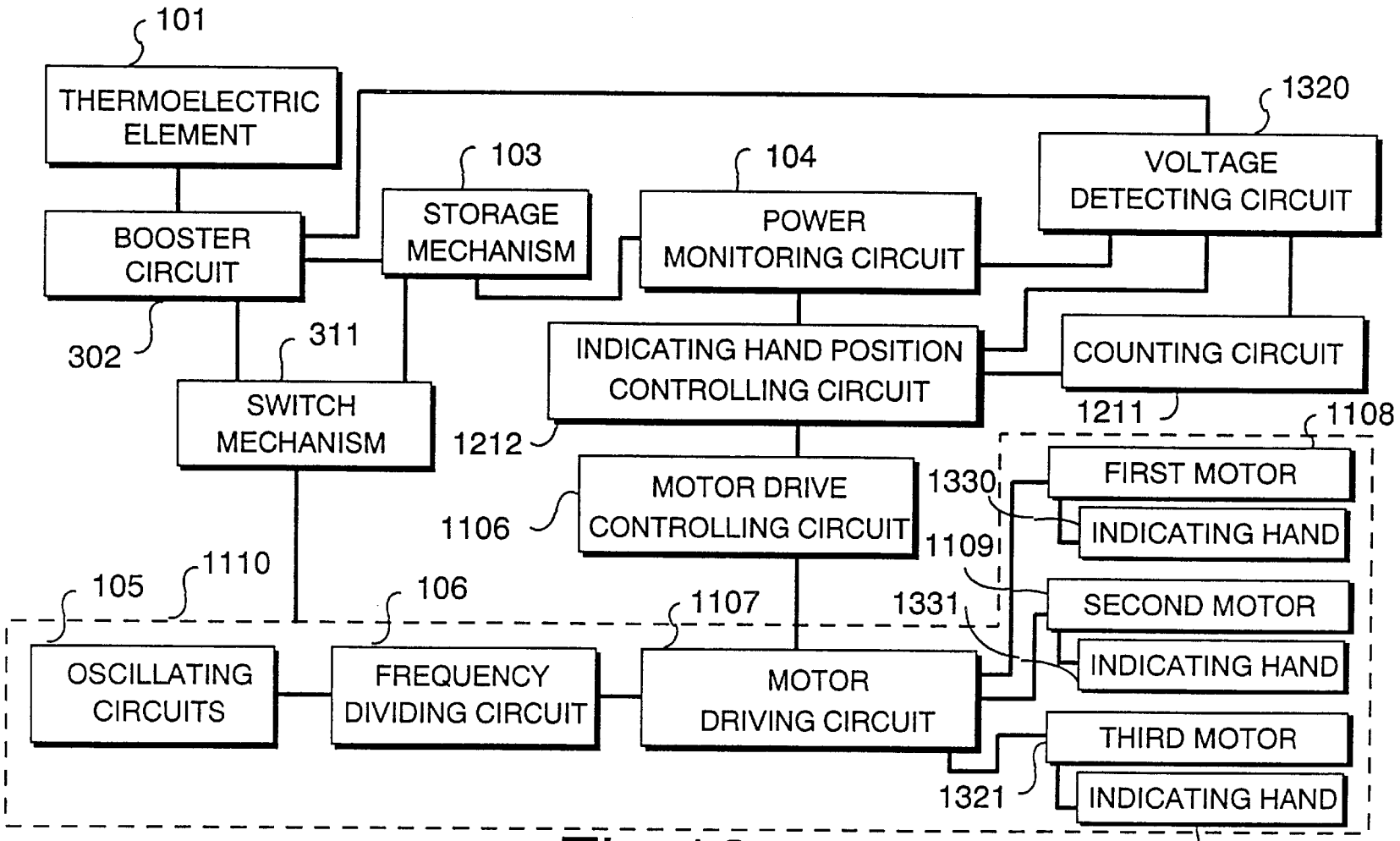
FIG. 19 is a block diagram showing another embodiment of an electronic timepiece having a thermoelectric element according to the present invention.

An explanation will be given of other embodiment of the present invention in reference to a block diagram of FIG. 19. The same numerals are used for portions the same as those in the block diagram of the above-described embodiment and an explanation thereof will be omitted.

According to the above-described embodiment, after elapse of 72 hours which is the second predetermined value of the counting circuit 1211, the hour hand and the minute hand of the moving indicating hand 1331 are stopped at predetermined positions via the second motor 1109 and a wheel train (not illustrated) connected to the second motor 1109 and time display is stopped.

According to the embodiment, there is constructed a constitution in which the hour hand and the minute hand of the indicating hand 1331 which are moved via the second motor 1109 and a wheel train (not illustrated) connected to the second motor 1109 of the above-described embodiment, are individually operated and the indicating hand 1331 constituting the hour hand as well as the second motor constituting drive source of the indicating hand 1331 and an indicating hand 1332 constituting the minute hand and a third motor 1321 constituting the drive source of the indicating hand 1332, are provided. The counting circuit 1211 outputs the second count completion signal to the indicating hand position controlling circuit 1212 after elapse of 72 hours which is the second predetermined value.

The indicating hand position controlling circuit 1212 outputs an indicating hand coincidence signal to the motor drive controlling circuit 1106 to overlap the indicating hand 1332 on the indicating hand 1331 in accordance with the second count completion signal outputted from the counting circuit 1211.

The motor drive controlling circuit 1106 drives the motor driving circuit 1107 and the third motor 1321 connected to the motor driving circuit 1107 to overlap the indicating hand 1332 on the indicating hand 1331 by the indicating hand coincidence signal outputted from the indicating hand position controlling circuit 1212, moves the indicating hand 1332 by a wheel train (not illustrated) connected to the third motor 1321 and overlaps it on the indicating hand 1331. Thereafter, the indicating hand 1332 carries out time display by moving the hand in accordance with intervals of moving the indicating hand 1331.

In this case, in the case of a timepiece in which the indicating hand 1331 and the indicating hand 1332 rotate concentrically to display time, when 12 hours are required for the indicating hand 1331 constituting the hour hand and 1 hour is required for the indicating hand 1332 constituting the minute hand to make one turn on the concentric circle, numbers of moving hands necessary for carrying out time display, supposedly, for 12 hours, are as follows. When the indicating hand 1332 constituting the minute hand is moved at intervals of 10 seconds, it needs to move by 4320 times. When the indicating hand 1331 constituting the hour hand is moved at intervals of 120 seconds, it needs to move by 360 times. The numbers of moving the hands in the case in which the indicating hand 1331 and the indicating hand 1332 carry out time display of hour and minute of 12 hours, amount to 4680 times. Numbers of moving hands in the case in which time display of hour is carried out by overlapping the indicating hand 1332 on the indicating hand 1331 to thereby constitute a one hand display, is 720 times. Accordingly, a ratio of 720/4680 is constituted in contrast to the time display of hour and minute by the indicating hand 1332 and the indicating hand 1331 and simple time display can be carried out by a number of moving hands of 1/6.5.

Figure 20B:
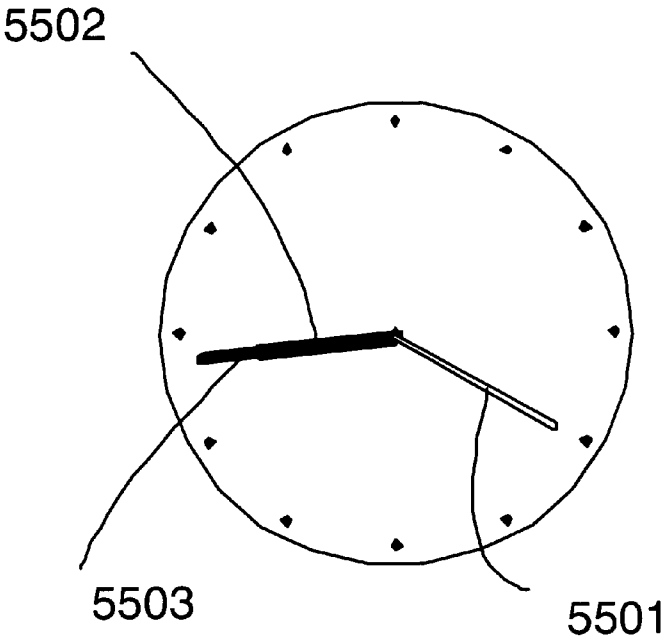
FIGS. 20A–20B shows views indicating examples of time displays used in the embodiment of FIG. 19.
Figure 20A:
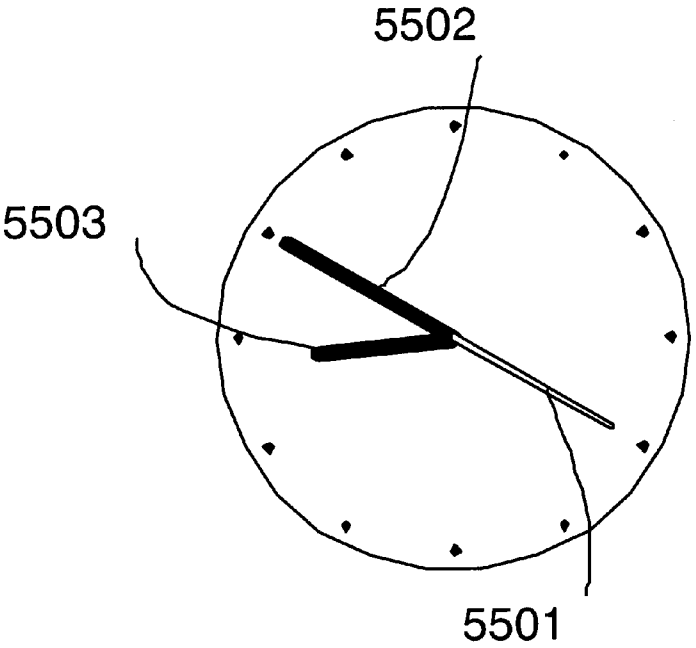

An explanation will be given of a display example in the case in which the indicating hand 1331 constituting the hour hand and the indicating hand 1332 constituting the minute hand are overlapped to thereby display the one hand display in reference to FIG. 20. The same numerals are used for portions the same as those in FIGS. 17 and 18. FIG. 20A shows a state immediately after 72 hours which is the second predetermined value have elapsed after the counting circuit 1211 started the counting operation. In this example, 8 o'clock and 50 minutes is indicated by the minute hand 5502 and the hour hand 5503 and the second hand 5501 indicates that the stored power of the storing means 103 falls in the range exceeding 60% and being equal to or lower than 80%. FIG. 20B shows a state in which time the same as that in FIG. 20A is displayed by overlapping the minute hand 5502 and the hour hand 5503.

In this way, the one hand display is constituted by overlapping the indicating hand 1331 and the indicating hand 1332, the number of moving the hands for time display can be reduced and while informing simplified time to a user, consumption of the stored power of the storage mechanism 103 can further be restrained.

Further, although a wheel train for transmitting drive force of a motor to an indicating hand is not illustrated in the respective block diagrams, when torque of each motor is large and the indicating hand can be moved without via the wheel train, the wheel train is not needed.

Finally, an explanation will be given of an object which the power monitoring circuit according to the present invention monitors. The output voltage of the thermoelectric element can also be compared directly with reference voltage. This case is featured in that a post stage circuit of the booster circuit or the like needs not to operate and the response from start of power generation to detection is fast. Further, output current of the thermoelectric element can also be detected by monitoring voltage across both terminals of a transistor switch for transmitting the output from the thermoelectric element to the booster circuit at a post stage. In this case, transmission of power of thermoelectric output to the post stage can be confirmed.

Further, the output voltage from the booster circuit for boosting the output from the thermoelectric element can also be monitored. In this case, detection is facilitated since voltage of the boosted output is high. Further, similar to detection of the output current from the thermoelectric element, transmission of current of the boosted output to the storage mechanism or the timepiece unit can be confirmed by voltage across both terminals of a transistor switch transmitting the output from the booster circuit to the post stage.

Further, an amount of stored energy can also be confirmed by monitoring voltage of the storage mechanism or an operational situation of the timepiece unit can also be confirmed by monitoring the power source voltage of the timepiece unit or combinations of monitoring operation of the above-described respective portions can also be used.

By using the electronic timepiece having a thermoelectric element according to the present invention, a time period for recovering the function of the thermoelectric element after power generation is restarted caused by excessive drop of voltage of the storage mechanism for maintaining power generated by the thermoelectric element, can be maintained at minimum.

Further, according to the constitution in which a portion of the function is stopped operating while holding time information, consumed current can be reduced and a time period for maintaining the function of measuring time can be prolonged.

Further, according to the constitution in which a situation of power generation and a situation of stored energy are informed to a user, the user can recognize a deficiency in energy before the function of the timepiece is stopped and can carry out replenishment of energy at an early stage.

By these effect, the way of using a thermally power generating timepiece with no need of interchanging a battery is extremely improved and maintenance in normal use is dispensed with.

Further, when several minutes have elapsed in a state in which the thermoelectric element does not generate power, the indicating hands stop time display and display a state of stored energy of the storage mechanism by which the user can be informed of the fact that no power is generated from the thermoelectric element and the situation of the stored energy of the storage mechanism. Further, an amount of consumption of stored energy of the storage mechanism can significantly be reduced and the thermoelectric element can be expedited to generate power such that power is generated at an early stage.

Further, the indicating hands except the indicating hand for displaying the state of the stored energy of the storage mechanism, continue the state of moving the hands and carry out time display and accordingly, the user can confirm the state of stored energy of the storage mechanism and time at the same time and new operation for informing the state of stored energy of the storage mechanism needs not to carry out.

Further, when a state in which no power is generated from the thermoelectric element for a long period of time is continued, by carrying out time display by overlapping the indicating hands for time display which are different from the second hand, the number of times of moving the indicating hands is reduced, the amount of consuming stored energy of the storage mechanism is reduced and a time period until the indicating hands are stopped can be prolonged.

Further, when power generation is restarted in the thermoelectric element after the state in which no power is generated from the thermoelectric element has continued and the indicating hands have stopped, by recovering the indicating hands to positions at current time, the user needs not to correct time.

What is claimed is:

1. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; power monitoring means for monitoring the electromotive force boosted by the booster circuit to detect whether the boosted electromotive force is lower than a threshold value; an oscillation circuit connected to be driven by electrical power stored in the storage mechanism; a dividing circuit for frequency-dividing a signal output by the oscillation circuit; a display mechanism for displaying time; a display driving circuit for driving the display mechanism to display time in accordance with an output signal from the dividing circuit; and a display drive controlling circuit for stopping operation of the display driving circuit when the power monitoring means detects that the boosted electromotive force is lower than the threshold value.

2. An electronic timepiece according to claim 1; further comprising a time correction controlling circuit for measuring a duration of time that the display drive controlling circuit stops the operation of the display driving circuit when the power monitoring means detects that the boosted electromotive force is lower than the threshold value; and wherein when the power monitoring means detects that the electromotive force has been restored to a level above the threshold value, the display drive controlling circuit restarts the operation of the display driving circuit and corrects a deviation in the time displayed by the display mechanism in accordance with the duration of time measured by the time correction controlling circuit.

3. An electronic timepiece according to claim 2; wherein the power monitoring means includes means for detecting whether the boosted electromotive force is lower than a threshold value by monitoring an output voltage or current of the thermoelectric element.

4. An electronic timepiece according to claim 2; wherein the power monitoring means includes means for detecting whether the boosted electromotive force is lower than a threshold value by monitoring an output voltage or current of the booster circuit.

5. An electronic timepiece according to claim 1; wherein the power monitoring means includes means for detecting whether the boosted electromotive force is lower than a threshold value by monitoring an output voltage or current of the thermoelectric element.

6. An electronic timepiece according to claim 1; wherein the power monitoring means includes means for detecting whether the boosted electromotive force is lower than a threshold value by monitoring an output voltage or current of the booster circuit.

7. An electronic timepiece according to claim 1; wherein the display mechanism comprises a plurality of hands for displaying time.

8. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; power monitoring means for monitoring the electromotive force boosted by the booster circuit to detect whether the boosted electromotive force is lower than a threshold value; an oscillation circuit connected to be driven by electrical power stored in the storage mechanism; a time information calculating circuit for calculating and storing current time information; a digital display mechanism for displaying time; a display driving circuit for driving the digital display mechanism to display time; and a display drive controlling circuit for stopping operation of the display driving circuit when the power monitoring means detects that the boosted electromotive force is lower than the threshold value.

9. An electronic timepiece according to claim 8; wherein the power monitoring means includes means for detecting whether the boosted electromotive force is lower than a threshold value by monitoring an output voltage or current of the thermoelectric element.

10. An electronic timepiece according to claim 8; wherein the power monitoring means includes means for detecting whether the boosted electromotive force is lower than a threshold value by monitoring an output voltage or current of the booster circuit.

11. An electronic timepiece comprising; a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; power monitoring means for monitoring the electromotive force boosted by the booster circuit to detect whether the boosted electromotive force is lower than a threshold value; an oscillation circuit connected to be driven by electrical power stored in the storage mechanism; a dividing circuit for frequency-dividing a signal output by the oscillation circuit; a display mechanism for displaying time; a display driving circuit for driving the display mechanism to display time in accordance with an output signal from the dividing circuit; and an operation stopping circuit for stopping operation of the oscillation circuit or the dividing circuit when the power monitoring means detects that the boosted electromotive force is lower than the threshold value.

12. An electronic timepiece according to claim 11; wherein the power monitoring means includes means for detecting whether the boosted electromotive force is lower than a threshold value by monitoring an output voltage or current of the thermoelectric element.

13. An electronic timepiece according to claim 11; wherein the power monitoring means includes means for detecting whether the boosted electromotive force is lower than a threshold value by monitoring an output voltage or current of the booster circuit.

14. An electronic timepiece according to claim 11; wherein the display mechanism comprises a plurality of hands for displaying time.

15. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; power monitoring means for monitoring the electromotive force boosted by the booster circuit to detect whether the boosted electromotive force is lower than a threshold value; an oscillation circuit connected to be driven by electrical power stored in the storage mechanism; a time information calculating circuit for calculating and storing current time information; a digital display mechanism for displaying time; a display driving circuit for driving the digital display mechanism to display time; and an operation stopping circuit for stopping operation of the oscillation circuit or the time information calculating circuit when the power monitoring means detects that the boosted electromotive force is lower than the threshold value.

16. An electronic timepiece according to claim 15; wherein the power monitoring means includes means for detecting whether the boosted electromotive force is lower than a threshold value by monitoring an output voltage or current of the thermoelectric element.

17. An electronic timepiece according to claim 15; wherein the power monitoring means includes means for detecting whether the boosted electromotive force is lower than a threshold value by monitoring an output voltage or current of the booster circuit.

18. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; power monitoring means for monitoring the electromotive force boosted by the booster circuit to detect whether the boosted electromotive force is lower than a threshold value; an oscillation circuit connected to be driven by electrical power stored in the storage mechanism; a dividing circuit for frequency-dividing a signal output by the oscillation circuit; a display mechanism for displaying time; a plurality of motors connected to the display mechanism through a wheel train for driving the display mechanism to display time; a motor driving circuit for driving the plurality of motors in accordance with an output signal from the dividing circuit; and a motor drive controlling circuit for stopping operation of at least one of the motors when the power monitoring means detects that the boosted electromotive force is lower than the threshold value.

19. An electronic timepiece according to claim 18; wherein the power monitoring means includes means for detecting whether the boosted electromotive force is lower than a threshold value by monitoring an output voltage or current of the thermoelectric element.

20. An electronic timepiece according to claim 18; wherein the power monitoring means includes means for detecting whether the boosted electromotive force is lower than a threshold value by monitoring an output voltage or current of the booster circuit.

21. An electronic timepiece according to claim 18; wherein the display mechanism comprises a plurality of hands for displaying time.

22. An electronic timepiece according to claim 21; wherein one of the plurality of hands comprises a second hand driven by one of the plurality of motors; and wherein the motor driving controlling circuit stops operation of the motor for driving the second hand when the power monitoring means detects that the boosted electromotive force is lower than the threshold value.

23. An electronic timepiece according to claim 22 wherein the power monitoring means includes means for detecting whether the boosted electromotive force is lower than a threshold value by monitoring an output voltage or current of the thermoelectric element.

24. An electronic timepiece according to claim 22; wherein the power monitoring means includes means for detecting whether the boosted electromotive force is lower than a threshold value by monitoring an output voltage or current of the booster circuit.

25. An electronic timepiece according to claim 22; further comprising a second hand position controlling circuit for controlling a position of the second hand; wherein when the power monitoring means detects that the boosted electromotive force is lower than the threshold value, the second hand position controlling circuit controls movement of the second hand until the second hand is disposed at a specified position and the motor drive controlling circuit stops operation of the motor for driving the second hand when the second hand is disposed at the specified position.

26. An electronic timepiece according to claim 25 wherein the power monitoring means includes means for detecting whether the boosted electromotive force is lower than a threshold value by monitoring an output voltage or current of the thermoelectric element.

27. An electronic timepiece according to claim 25; wherein the power monitoring means includes means for detecting whether the boosted electromotive force is lower than a threshold value by monitoring an output voltage or current of the booster circuit.

28. An electronic timepiece according to claim 25; wherein the second hand position controlling circuit controls movement of the second hand to stop the second hand at one of a plurality of specified positions each indicative of a condition in which electromotive force has or has not been generated by the thermoelectric element.

29. An electronic timepiece according to claim 28 wherein the power monitoring means includes means for detecting whether the boosted electromotive force is lower than a threshold value by monitoring an output voltage or current of the thermoelectric element.

30. An electronic timepiece according to claim 28; wherein the power monitoring means includes means for detecting whether the boosted electromotive force is lower than a threshold value by monitoring an output voltage or current of the booster circuit.

31. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; power monitoring means for monitoring an output from the booster circuit to detect whether the output from the booster circuit is lower than a threshold value; a counting circuit for measuring a time period from when the output from the booster circuit is detected to be lower than the threshold value; an oscillation circuit connected to be driven by electrical power stored in the storage mechanism; a dividing circuit for frequency-dividing a signal output by the oscillation circuit; a time information calculating circuit for calculating and storing current time information; a display mechanism for displaying time; a display driving circuit for driving the display mechanism to display time; and an operation stopping circuit for stopping operation of the oscillation circuit, the dividing circuit, the time information calculating circuit or the display driving circuit; wherein the counting circuit begins measuring the time period when the output from the booster circuit is detected by the power monitoring means to be lower than the threshold value, and wherein when the lower threshold value is continued to be detected by the power monitoring means for a constant time period or more, the operation stopping circuit stops the oscillating circuit, the dividing circuit, the time information calculating circuit or the display driving circuit.

32. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; power monitoring means for monitoring an output from the booster circuit to detect whether the output from the booster circuit is lower than a threshold value; a counting circuit for measuring a time period from when the output from the booster circuit is detected to be lower than the threshold value; an oscillation circuit connected to be driven by electrical power stored in the storage mechanism; a dividing circuit for frequency-dividing a signal output by the oscillation circuit; a time information calculating circuit for calculating and storing current time information; a frequency division resetting mechanism for correcting the time information; a display mechanism for displaying the time information; a display driving circuit for driving the display mechanism to display the time information; and an operation stopping circuit for stopping operation of the oscillation circuit, the dividing circuit, the time information calculating circuit or the display driving circuit; wherein the counting circuit begins measuring the time period in the condition in which the frequency division resetting mechanism is operated and the output from the booster circuit is detected by the power monitoring means to be lower than the threshold value, and wherein when the condition continues for a constant time period or more, the operation stopping circuit stops the oscillating circuit, the dividing circuit, the time information calculating circuit or the display driving circuit.

33. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; a power monitoring circuit for monitoring the electromotive force boosted by the boosted circuit; a voltage detecting circuit for detecting an output voltage of the booster circuit; a counting circuit for starting a count operation when the output voltage of the booster circuit detected by the voltage detecting circuit is lower than a threshold voltage; a display mechanism having a plurality of indicating hands for displaying time; an indicating hand position controlling circuit for setting a position at which one of the indicating hands is stopped in accordance with an output from the power monitoring circuit; a motor drive controlling circuit from driving the indicating hand to the stopped position in accordance with an output from the indicating hand position controlling circuit; an oscillation circuit connected to be driven by electrical power stored in the storage mechanism; a dividing circuit for frequency-dividing a signal output by the oscillation circuit; a plurality of motors connected to the display mechanism for driving the indicating hands to display time; and a motor driving circuit for driving the plurality of motors in accordance with an output signal from the dividing circuit; wherein when the voltage detecting circuit detects that the output voltage of the booster circuit is lower than the threshold voltage, the counting circuit starts a count operation and continues to count for a constant period of time or more, the indicating hand position controlling circuit sets the stop position of one of the indicating hand, and the indicating hand is driven to the stop position by the motor drive controlling circuit, the motor driving circuit and at least one of the motors to carry out a display different from a time display.

34. An electronic timepiece according to claim 33; wherein one of the plurality of indicating hands comprises a second hand.

35. An electronic timepiece according to claim 33; wherein one of the plurality of indicating hands comprises a second hand.

36. An electronic timepiece according to claim 35; wherein the power monitoring circuit has a plurality of threshold values for detecting the electrical power in the storage mechanism; and wherein the indicating hand position controlling circuit has a plurality of indicating hand stopping positions corresponding respectively to the threshold values of the power monitoring circuit for displaying states of the electrical power stored in the storage mechanism.

37. An electronic timepiece according to claim 36; wherein one of the plurality of indicating hands different from the second hand continues to display time information when the indicating hand driven to the stop position by the motor drive controlling circuit, the motor driving circuit and at least one of the motors carries out a display different from a time information display.

38. An electronic timepiece according to claim 34; wherein the indicating hand position controlling circuit stops at least one or more of the plurality of indicating hands different from the second hand after elapse of a time period different from the constant time period counted by the counting circuit.

39. An electronic timepiece according to claim 33; wherein the indicating hand position controlling circuit controls at least on or more of the plurality of indicating hands to overlap one another to carry out the time display after elapse of a time period different from the constant time period counted by the counting circuit.

40. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; a power monitoring circuit for monitoring the electromotive force boosted by the booster circuit to detect whether the boosted electromotive force is lower than a threshold value; a display mechanism for displaying time; a display driving circuit for driving the display mechanism to display time; and a display drive controlling circuit for stopping the driving operation of the display driving circuit when the power monitoring circuit detects that the boosted electromotive force is lower than the threshold value.

41. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; a power monitoring circuit for monitoring the electromotive force boosted by the booster circuit to detect whether the boosted electromotive force is lower than a threshold value; a display mechanism for displaying time and driven by the electrical power stored by the storage mechanism; and a display drive controlling circuit for stopping operation of the display mechanism when the power monitoring means detects that the boosted electromotive force is lower than the threshold value.

42. An electronic timepiece according to claim 41; wherein the display drive controlling circuit releases the stopping operation of the display mechanism when the power monitoring circuit detects that the boosted electromotive force exceeds the threshold value.

43. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; a power monitoring circuit for monitoring the electrical power stored by the storage mechanism to detect whether the electrical power is lower than a threshold value; a switch mechanism for selecting the higher of an output voltage from the booster circuit and an output voltage from the storage mechanism; a display mechanism for displaying time and driven by the output voltage selected by the switch mechanism; and a display drive controlling circuit for stopping operation of the display mechanism when the power monitoring circuit detects that the stored electrical power is lower than the threshold value.

44. An electronic timepiece according to claim 43; wherein the display drive controlling circuit releases the stopping operation of the display mechanism when the power monitoring circuit detects that the electrical power stored in the storage mechanism exceeds the threshold value.

45. An electronic timepiece comprising: a thermoelectric element for generating an electromotive force in response to a temperature difference thereacross; a booster circuit for boosting the electromotive force generated by the thermoelectric element; a storage mechanism for storing electrical power utilizing the electromotive force boosted by the booster circuit; a switch mechanism for selecting the higher of an output voltage from the booster circuit and an output voltage from the storage mechanism; a power monitoring circuit for monitoring the output voltage selected by the switch mechanism to detect whether the output voltage is lower than a threshold value; a display mechanism for displaying time and driven by the output voltage selected by the switch mechanism; and a display drive controlling circuit for stopping operation of the display mechanism when the power monitoring circuit detects that the output voltage from the switch mechanism is lower than the threshold value.

46. An electronic timepiece according to claim 45; wherein the display drive controlling circuit releases the stopping operation of the display mechanism when the power monitoring circuit detects that the output voltage selected by the switch mechanism exceeds the threshold value.

47. An electronic timepiece according to claim 45; further comprising a time correction controlling circuit for measuring a duration of time that the display drive controlling circuit stops the operation of the display mechanism when the power monitoring circuit detects that the output voltage from the switch mechanism is lower than the threshold value; and wherein when the power monitoring circuit detects that the output voltage has been restored to a level above the threshold value, the display drive controlling circuit restarts the operation of the display mechanism and corrects a deviation in the time displayed by the display mechanism in accordance with the duration of time measured by the time correction controlling circuit.

48. An electronic timepiece according to claim 45; wherein the display drive controlling circuit controls the display mechanism to stop at a preselected position.

49. An electronic timepiece according to claim 45; further comprising a counting circuit for counting a duration time period of a lowering of the output voltage selected by the switch mechanism; and wherein the display drive controlling circuit stops operation of the display mechanism when the duration time period reaches a preselected value.

50. An electronic timepiece according to claim 45; further comprising a resetting mechanism movable to an operable position; and wherein the display drive controlling circuit stops operation of the display mechanism when the resetting mechanism is in the operable position and a time period during which the power monitoring circuit detects the output voltage from the switch mechanism reaches a preselected value.

51. An electronic timepiece according to claim 45; wherein the power monitoring circuit has a plurality of threshold values for detecting the electrical power in the storage mechanism; and wherein the display drive controlling circuit controls the display mechanism in accordance with the threshold values of the power monitoring circuit.

* * * * *